US008075993B2

(12) United States Patent
Clough et al.

(10) Patent No.: US 8,075,993 B2
(45) **Date of Patent: *Dec. 13, 2011**

(54) PTFE FABRIC ARTICLES AND METHODS OF MAKING SAME

(75) Inventors: Norman Ernest Clough, Landenberg, PA (US); Sarah E. Fram, Newark, DE (US)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/536,766

(22) Filed: Aug. 6, 2009

(65) Prior Publication Data

US 2010/0159766 A1 Jun. 24, 2010

Related U.S. Application Data

(63) Continuation-in-part of application No. 12/340,038, filed on Dec. 19, 2008, now Pat. No. 7,968,190.

(51) Int. Cl.
*D02G 3/00* (2006.01)
*B05D 5/12* (2006.01)

(52) U.S. Cl. ..... 428/364; 442/164; 427/80

(58) Field of Classification Search ..... 442/2, 164, 442/181, 304, 327, 1, 192, 308, 334; 428/36.1, 428/357, 360, 361, 364, 365, 221, 34.1, 400
See application file for complete search history.

(56) References Cited

U.S. PATENT DOCUMENTS

| | | | | |
|---|---|---|---|---|
| 3,953,566 | A | 4/1976 | Gore | 264/288 |
| 4,187,390 | A | 2/1980 | Gore | 174/102 R |
| 4,208,745 | A | 6/1980 | Okita | 3/1.4 |
| 4,647,416 | A | 3/1987 | Seiler, Jr. et al. | 264/118 |
| 5,264,100 | A * | 11/1993 | Shimohira et al. | 204/296 |
| 5,296,292 | A | 3/1994 | Butters | 428/375 |
| 5,462,781 | A | 10/1995 | Zukowski | 428/36.1 |
| 5,466,509 | A | 11/1995 | Kowligi et al. | 428/141 |
| 5,747,128 | A | 5/1998 | Campbell et al. | 428/35.7 |
| 6,573,311 | B1 | 6/2003 | Martakos et al. | 522/157 |
| 7,615,282 | B2 | 11/2009 | Lutz et al. | |
| 7,736,739 | B2 * | 6/2010 | Lutz et al. | 428/400 |
| 7,740,020 | B2 | 6/2010 | Lutz et al. | |
| 2006/0047311 | A1 | 3/2006 | Lutz et al. | 606/228 |
| 2010/0159766 | A1 | 6/2010 | Clough et al. | |

* cited by examiner

*Primary Examiner* — Arti Singh-Pandey
(74) *Attorney, Agent, or Firm* — Amy L. Miller

(57) ABSTRACT

Unique PTFE fabric and laminate structures, and methods for making the same, are described. Particularly, the invention comprises a laminate of a fabric comprising a plurality of PTFE fibers overlapping at intersections, wherein at least a portion of the intersections have PTFE masses extending from at least one of the overlapping PTFE fibers, and which lock the overlapping PTFE fibers together, bonded to a membrane by at least said PTFE masses. Such reinforced membranes exhibit exceptionally high bond strength, a particularly valuable attribute in applications in which durability is important.

28 Claims, 31 Drawing Sheets

| Patent Example # | Fiber Type (ePTFE) | Fiber Denier (d) | Fiber Density (g/cc) | Construction | Membrane | Process Steps |
|---|---|---|---|---|---|---|
| Example 12a | V112403 | 90 | ~ 2.2 | 49.2 ends/cm by 49.2 picks/cm | 11320na (0.2 micron) | plasma => heat => hot compress |
| Example 12b | V112403 | 90 | ~ 2.2 | 49.2 ends/cm by 49.2 picks/cm | 11320na (0.2 micron) | plasma => hot compress |
| Comparative Example F | V112403 | 90 | ~ 2.2 | 49.2 ends/cm by 49.2 picks/cm | 11320na (0.2 micron) | hot compress |
| Example 13a | V112403 | 90 | ~ 2.2 | 31.5 ends/cm and 23.6 picks/cm | 11320na (0.2 micron) | plasma => heat => hot compress |
| Example 13b | V112403 | 90 | ~ 2.2 | 31.5 ends/cm and 23.6 picks/cm | 11320na (0.2 micron) | plasma => hot compress |
| Comparative Example G | V112403 | 90 | ~ 2.2 | 31.5 ends/cm and 23.6 picks/cm | 11320na (0.2 micron) | hot compress |
| Example 14 | 1GGNF03 | 150 | ~ 2.2 | 17 courses/cm and 11 wales/cm areal density of 68 g/m2 | 11320na (0.2 micron) | plasma => hot compress |
| Comparative Example H | 1GGNF03 | 150 | ~ 2.2 | 17 courses/cm and 11 wales/cm areal density of 68 g/m2 | 11320na (0.2 micron) | hot compress |
| Example 15 | V112729 | 960 | 0.7 | 9.8 ends/cm and 12.6 picks/cm | 11320na (0.2 micron) | plasma => hot compress |
| Comparative Example I | V112729 | 960 | 0.7 | 9.8 ends/cm and 12.6 picks/cm | 11320na (0.2 micron) | hot compress |
| Example 16 | 10066697 | 90 | ~ 2.2 | 31.5 ends/cm and 23.6 picks/cm | 10066697 (1 micron) | plasma => hot compress |
| Comparative Example J | 10066697 | 90 | ~ 2.2 | 31.5 ends/cm and 23.6 picks/cm | 10066697 (1 micron) | hot compress |
| Example 17 | W112190 | 586 | 1.4 | 17.7 ends/cm and 19.7 picks/cm | 11320na (0.2 micron) | plasma => hot compress |
| Comparative Example K | W112190 | 586 | 1.4 | 17.7 ends/cm and 19.7 picks/cm | 11320na (0.2 micron) | hot compress |

FIG. 56

PTFE FABRIC ARTICLES AND METHODS OF MAKING SAME

CROSS-REFERENCE TO RELATED APPLICATION

This application is a continuation-in-part of allowed U.S. patent application Ser. No. 12/340,038 is now U.S. Pat. No. 7,968,190 filed Dec. 19, 2008.

FIELD OF THE INVENTION

The present invention relates to unique porous PTFE laminate articles. More specifically, novel structures of porous PTFE laminates and a novel process for preparing the structures are described.

BACKGROUND OF THE INVENTION

The structure of expanded PTFE ("ePTFE") is well known to be characterized by nodes interconnected by fibrils, as taught in U.S. Pat. Nos. 3,953,566 and 4,187,390, to Gore, and which patents have been the foundation for a significant body of work directed to ePTFE materials. The node and fibril character of the ePTFE structure has been modified in many ways since it was first described in these patents. For example, highly expanded materials, as in the case of high strength fibers, can exhibit exceedingly long fibrils and relatively small nodes. Other process conditions can yield articles, for example, with nodes that extend through the thickness of the article.

Surface treatment of ePTFE structure has also been carried out by a variety of techniques in order to modify the ePTFE structure. Okita (U.S. Pat. No. 4,208,745) teaches exposing the outer surface of an ePTFE tube, specifically a vascular prosthesis, to a more severe (i.e., higher) thermal treatment than the inner surface in order to effect a finer structure on the inside than on the outside of the tube. One of ordinary skill in the art will recognize that Okita's process is consistent with prior art amorphous locking processes, the only difference being preferential exposure of the outer surface of the ePTFE structure to greater thermal energy.

Zukowski (U.S. Pat. No. 5,462,781) teaches employing plasma treatment to effect removal of fibrils from the surface of porous ePTFE in order to achieve a structure with free-standing nodes on the surface which are not interconnected by fibrils. No further treatment after the plasma treatment is disclosed or contemplated in the teachings.

Martakos et al. (U.S. Pat. No. 6,573,311) teach plasma glow discharge treatment, which includes plasma etching, of polymer articles at various stages during the polymer resin processing. Martakos et al. distinguish over conventional processes by noting that the prior art techniques operate on finished, fabricated and/or finally processed materials, which are "ineffective at modifying bulk substrate properties, such as porosity and permeability." Martakos et al. teach plasma treating at six possible polymer resin process steps; however, no such treatment with or subsequent to amorphous locking is described or suggested. Again, Martakos et al. is directed to affecting bulk properties such as porosity and/or chemistry quality in the finished articles.

Other means of creating new surfaces on porous PTFE and treating the surface of porous PTFE abound in the prior art. Butters (U.S. Pat. No. 5,296,292) teaches a fishing flyline consisting of a core with a porous PTFE cover that can be modified to improve abrasion resistance. Abrasion resistance of the flyline is improved by modifying the outer cover either through adding a coating of abrasion resistant material or by densifying the porous PTFE cover.

Campbell et al. (U.S. Pat. No. 5,747,128) teach a means of creating regions of high and low bulk density throughout a porous PTFE article. Additionally, Kowligi et al. (U.S. Pat. No. 5,466,509) teach impressing a pattern onto an ePTFE surface, and Seiler et al. (U.S. Pat. No. 4,647,416) teach scoring PTFE tubes during fabrication in order to create external ribs.

Lutz et al. (US 2006/0047311 A1) teach unique PTFE structures comprising islands of PTFE extending from an underlying expanded PTFE structure and methods for making such structures.

None of these documents teaches a uniquely stabilized PTFE fabric or laminate structure.

For numerous conventional applications, including filtration, garments. etc., fabrics are bonded to membranes in order to reinforce them. The fabrics provide handleability and structural stability to otherwise relatively delicate membranes. PTFE fabrics offer unique advantages which include, but are not limited to, chemical inertness and extreme operating temperature range. Fabrics comprising expanded PTFE offer the further advantage of increased strength compared to non-expanded PTFE fabrics.

PTFE-based fabrics are inherently difficult to bond to membranes, and accordingly, the bonds tend to be weak. For applications demanding the benefits of PTFE or ePTFE fabric reinforcement, thermal bonding techniques, with or without the use of adhesives, are typically used to bond the fabric to the membrane. Since adhesives do not exhibit the same inertness or operating temperature range of PTFE or ePTFE, they tend to compromise the performance of the resultant laminate during use. Additionally, limitations in bond strengths of conventional adhesives, such as FEP and PFA and the like, can compromise product performance in such demanding applications as fluid filtration. Adhesives can also flow onto the membrane surface during the bonding process, thereby compromising membrane performance. For instance, in the case of filtration membranes, excess adhesive can inhibit flow through the affected portion of the membrane, thereby decreasing liquid or gas filtration effectiveness.

When the membrane to be bonded also comprises PTFE or ePTFE, achieving effective bonding can present even greater difficulty. EP 1094887 B1, to Griffin, and U.S. Pat. No. 4,983,434, to Sassa et al., teach examples of filtration products wherein fabrics comprising PTFE are bonded with adhesive to ePTFE membranes.

A long felt need has existed for laminates comprising PTFE fabric-reinforced membranes with enhanced peel strength.

SUMMARY OF THE INVENTION

The present invention is directed to a unique PTFE laminate structure comprising a plurality of PTFE fibers overlapping at intersections, wherein at least a portion of the intersections have PTFE masses which mechanically lock the overlapping PTFE fibers. The term "PTFE" is intended to include PTFE homopolymers and PTFE-containing polymers. By "PTFE fiber" or "fibers" is meant PTFE-containing fibers, including, but not limited to, filled fibers, blends of PTFE fiber and other fiber, various composite structures, fibers with PTFE outer surfaces. As used herein, the terms "structure" and "fabric" may be used interchangeably or together to refer to constructions comprising, but not limited to, knitted PTFE fibers, woven PTFE fibers, nonwoven PTFE fibers, laid scrims of PTFE fibers, perforated PTFE sheets, etc., and combinations thereof. The term "intersection(s)" refers to any location in a fabric where the PTFE fibers intersect or overlap, such as the cross-over points of the warp and weft fibers in a woven structure, the points where fibers touch in a knit, (e.g., interlocked loops, etc.), and any similar fiber contact points. The term "mass," or "masses," is meant to describe material that mechanically locks the overlapping fibers together at an intersection. By "mechanically lock" or "mechanically locked," is meant at least partially enveloping the fibers and minimizing movement or slippage of the fibers relative to one another at the intersections. The PTFE masses extend from at least one of the intersecting PTFE fibers. The PTFE fibers may be either monofilament fibers or multifilament fibers, or combinations thereof. The multifilament fibers can be combined in a twisted or untwisted configuration. Furthermore, the fibers in some embodiments can comprise expanded PTFE.

The method for forming the inventive PTFE articles comprises the following steps: forming a plurality of PTFE fibers into a structure having intersections of overlapping PTFE fibers; subjecting the structure to a plasma treatment; then subjecting the plasma treated structure to a heat treatment. In the resulting structures, at least a portion of the intersections of overlapping fibers have PTFE masses at said intersections, the PTFE masses extending from at least one of the overlapping, or intersecting, PTFE fibers.

The non-intersecting portions of the fibers may exhibit an appearance as described in US Patent Application Publication US 2006/0047311 A1, the subject matter of which is specifically incorporated herein in its entirety by reference. Specifically, the non-intersecting portions may exhibit islands of PTFE which are attached to and extend from the underlying expanded PTFE structure. These PTFE islands can be seen, upon visual inspection, to be raised above the expanded PTFE structures. The presence of PTFE in the islands can be determined by spectroscopic or other suitable analytical means. By "raised" is meant that when the article is viewed in cross-section, such as in a photomicrograph of the article cross-section, the islands are seen to rise above the baseline defined by the outer surface of the underlying node-fibril structure by a length, "h."

In an alternative embodiment of the invention, one or more filler materials may be incorporated into or with the PTFE structures. For example, it is possible to coat and/or impregnate one or more materials onto and/or into the PTFE fabrics and/or individual fibers of the fabrics of the present invention. In one embodiment of such a structure, an ionomer material may be incorporated with the PTFE fabric, which provides reinforcement, for use in electrolytic and other electrochemical (e.g., chlor-alkali) applications. Alternatively, organic fillers (e.g., polymers) and inorganic fillers may be incorporated with the PTFE fabrics of the invention. Alternatively, the PTFE fabrics may be incorporated as one or more layers of multi-layered structures.

The unique character of the present articles and processes enable the formation of improved products in a variety of commercial applications. For example, PTFE structures of the present invention can exhibit improved performance in such diverse product areas as chlor-alkali membranes, acoustic membranes, filtration media, medical products (including but not limited to implantable medical devices), and other areas where the unique characteristics of these materials can be exploited. PTFE articles of the present invention configured in membrane, tube, sheet, and other shaped geometries and forms can also provide unique benefits in finished products.

Articles of the present invention are particularly useful wherever fray resistance of the fabric is desired. Such articles have even greater value where the properties of PTFE and/or ePTFE are required.

In another embodiment, the invention comprises a laminate of a fabric comprising a plurality of PTFE fibers overlapping at intersections, wherein at least a portion of the intersections have PTFE masses extending from at least one of the overlapping PTFE fibers and locking the PTFE fibers together, the fabric being further bonded to a membrane by at least said PTFE masses. Such reinforced membranes exhibit exceptionally high bond strength, a particularly useful property in applications in which durability is important. Unique, PTFE fabric-reinforced PTFE membranes can be made which have strength and dimensional stability heretofore unavailable in conventional PTFE fabric/PTFE membrane laminates.

These and other unique embodiments and features of the present invention will be described in more detail herein.

DETAILED DESCRIPTION OF THE FIGURES

The operation of the present invention should become apparent from the following description when considered in conjunction with the accompanying drawings, in which:

FIGS. 1 and 2 are scanning electron photomicrographs (SEMs) at 100× and 250× magnifications, respectively, of the surface of the article made in Example 1a.

FIGS. 3 and 4 are SEMs at 250× and 500× magnifications, respectively, of the cross-section of the article made in Example 1a.

FIGS. 28, 29, 30, and 31 are SEMs at 25×, 100×, 100× and 250× magnifications, respectively, of the surface of the article made in Example 1a after being subjected to the fray resistance via fiber removal test.

Figure 32:
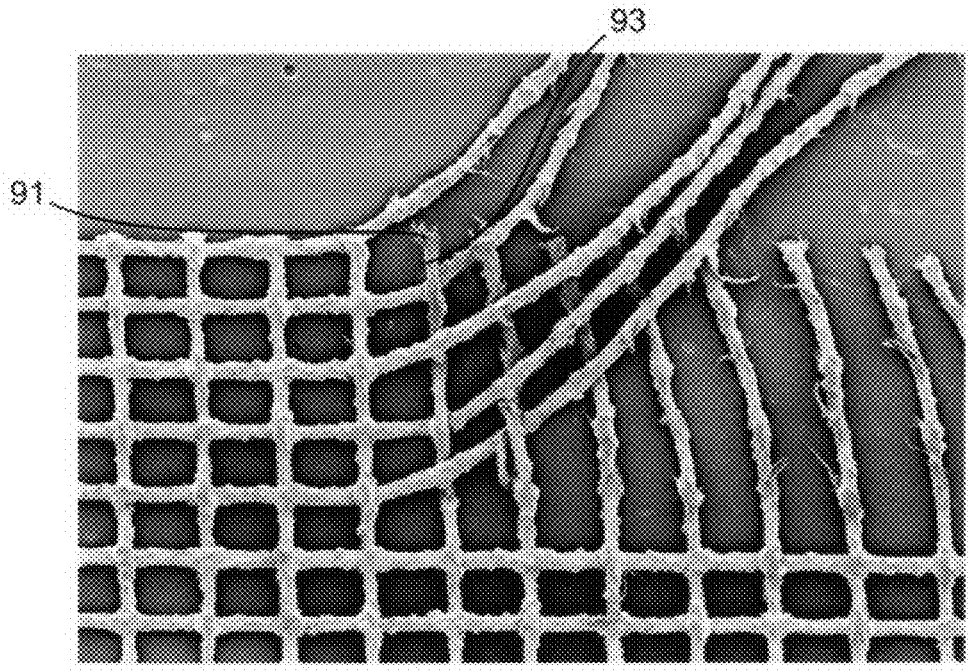
Figure 33:
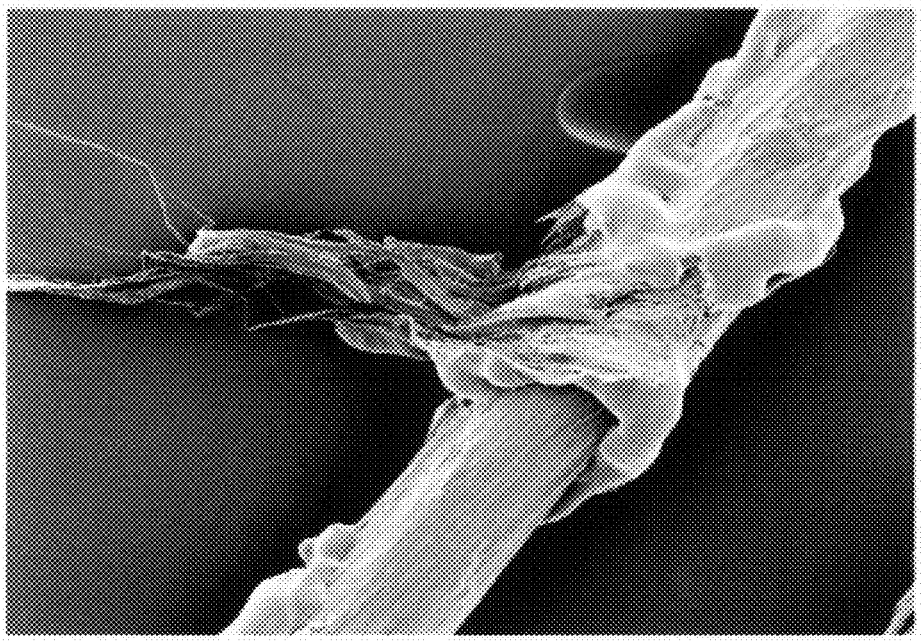

FIGS. 32 and 33 are SEMs at 25× and 250× magnifications, respectively, of the surface of the article made in Example 1b after being subjected to the fray resistance via fiber removal test.

Figure 34:
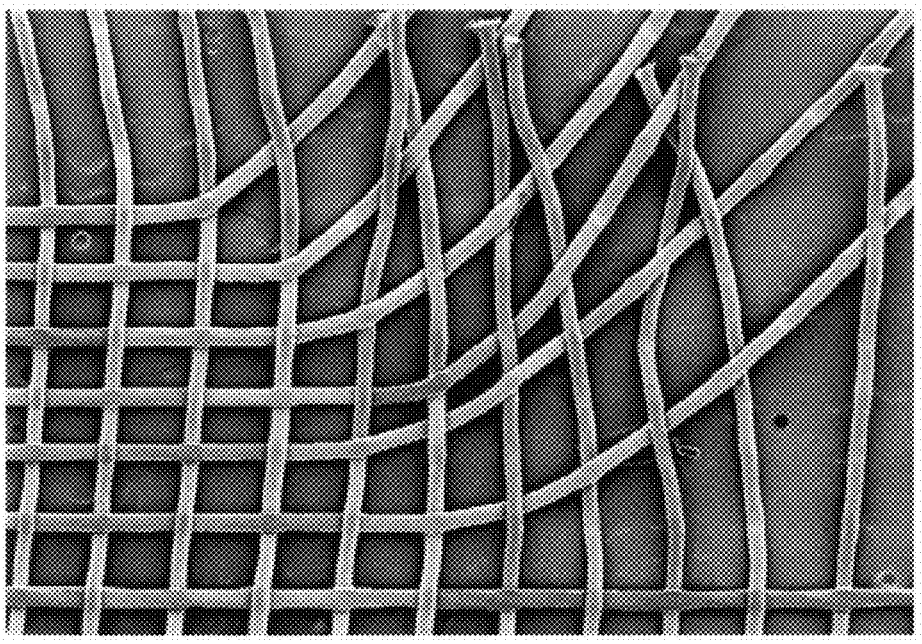
Figure 35:
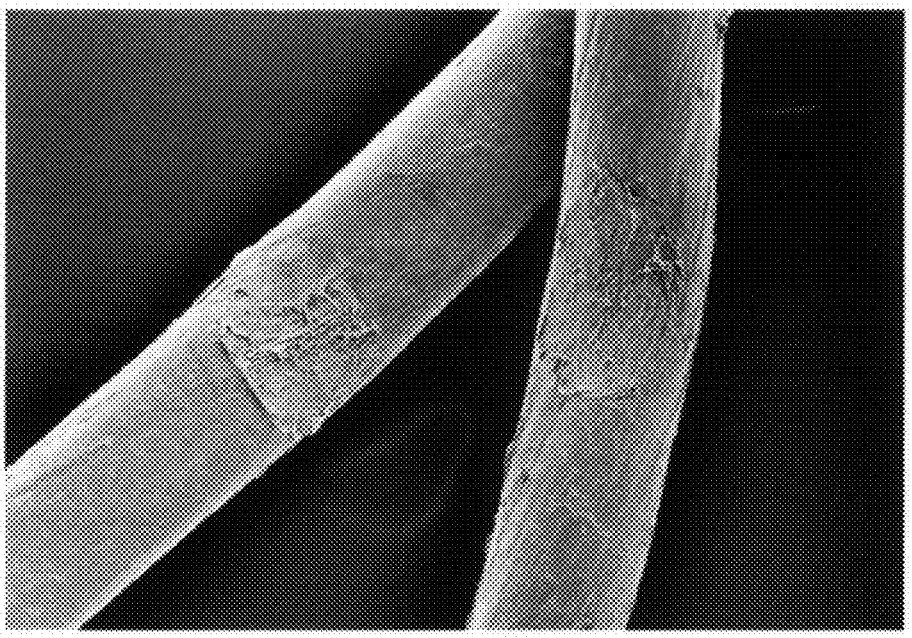

FIGS. 34 and 35 are SEMs at 25× and 250× magnifications, respectively, of the surface of the article made in Comparative Example A after being subjected to the fiber removal test.

Figure 36:
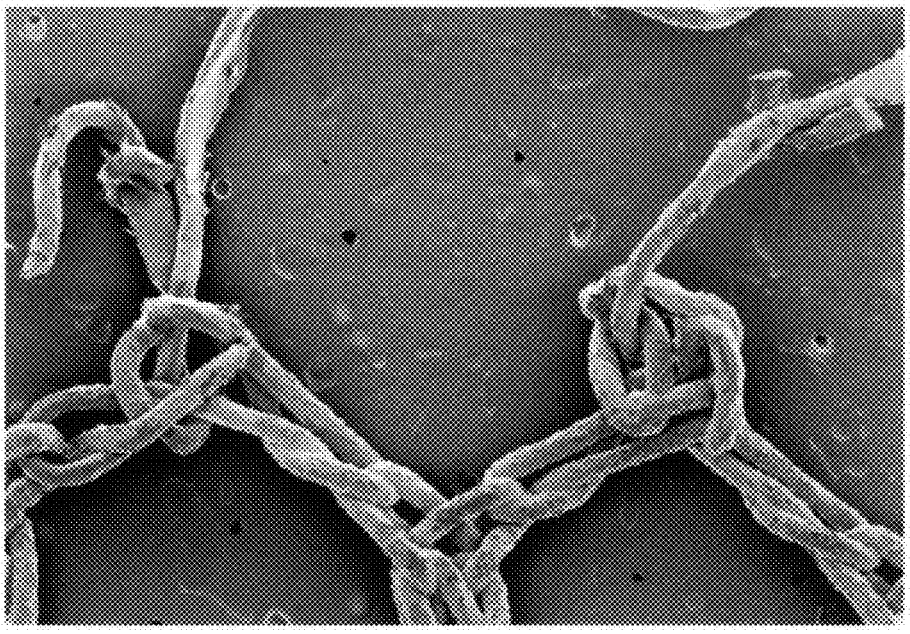
Figure 37:
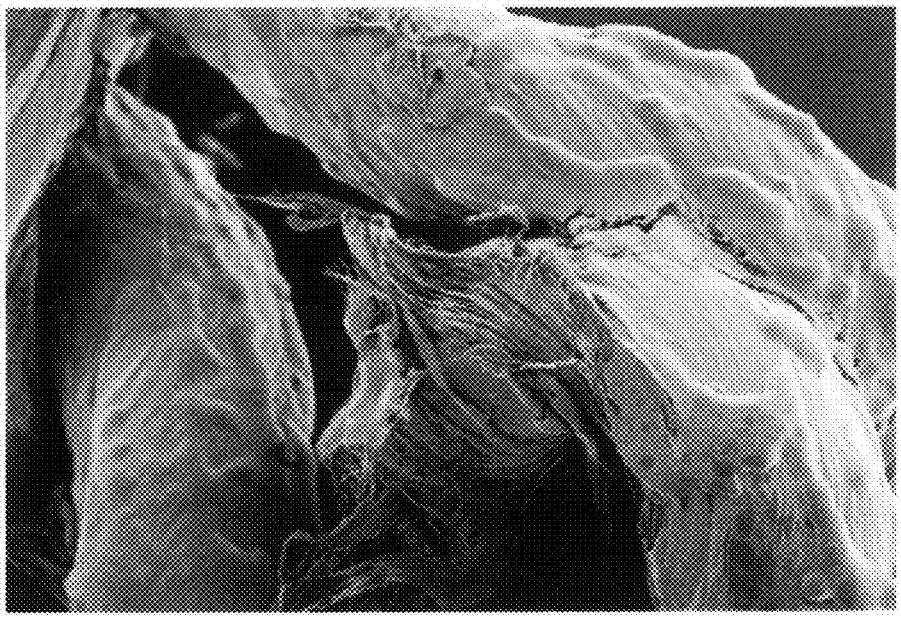

FIGS. 36 and 37 are SEMs at 25× and 250× magnifications, respectively, of the surface of the article made in Example 3 after being subjected to the fiber removal test.

Figure 38:
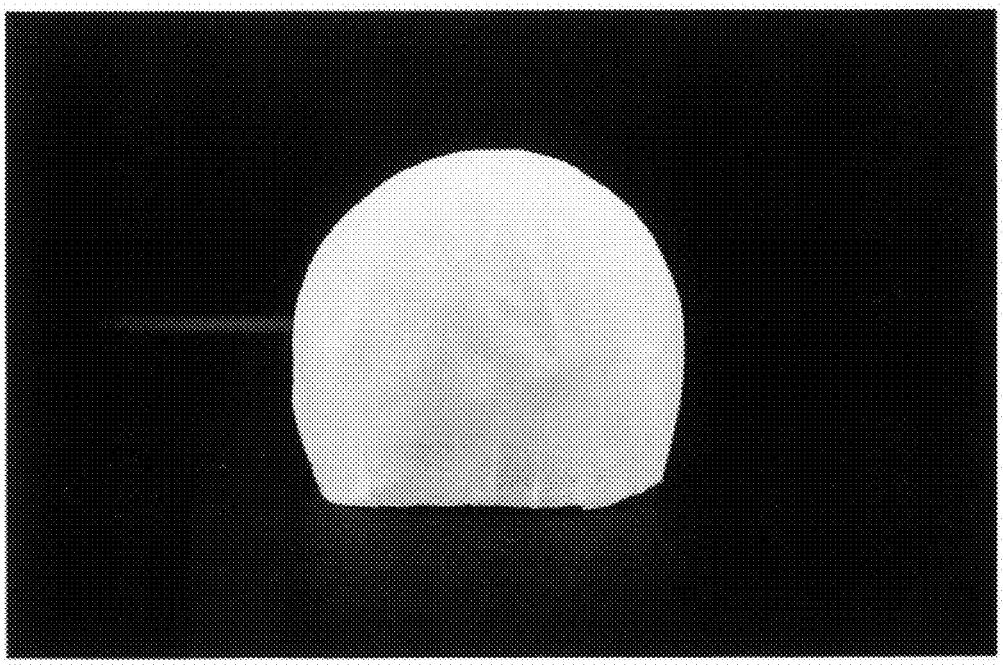

FIG. 38 is a photograph of the shaped article made in Example 9.

Figure 39:
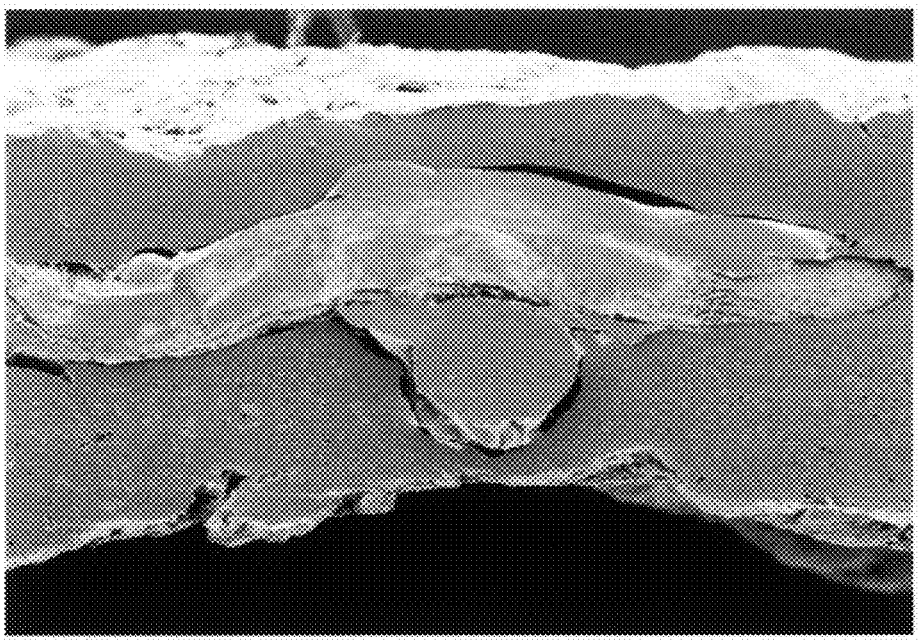

FIG. 39 is an SEM at 250× of the cross-section of the article of Example 10.

Figure 40:
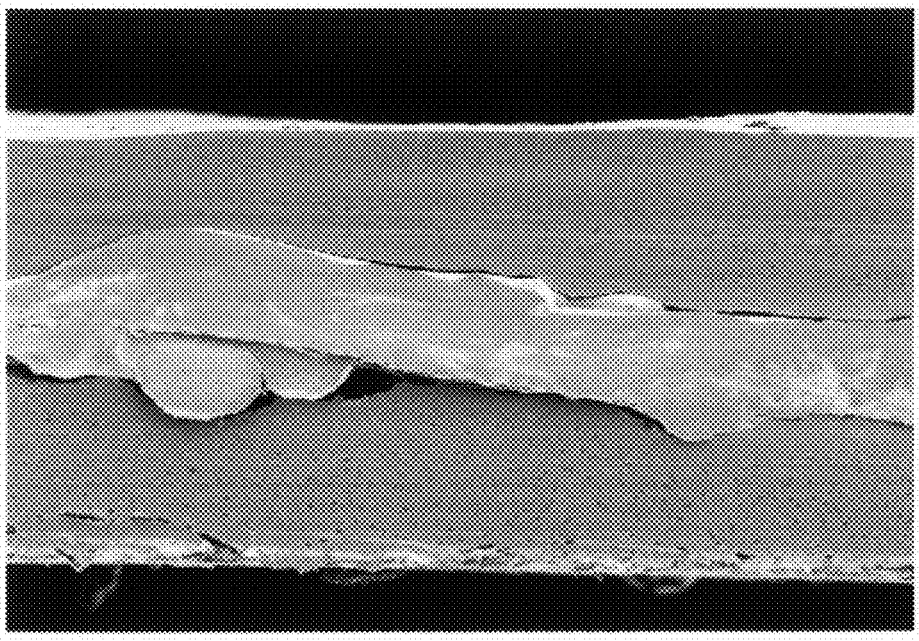

FIG. 40 is an SEM at 250× of the cross-section of the article of Example 11.

Figure 41:
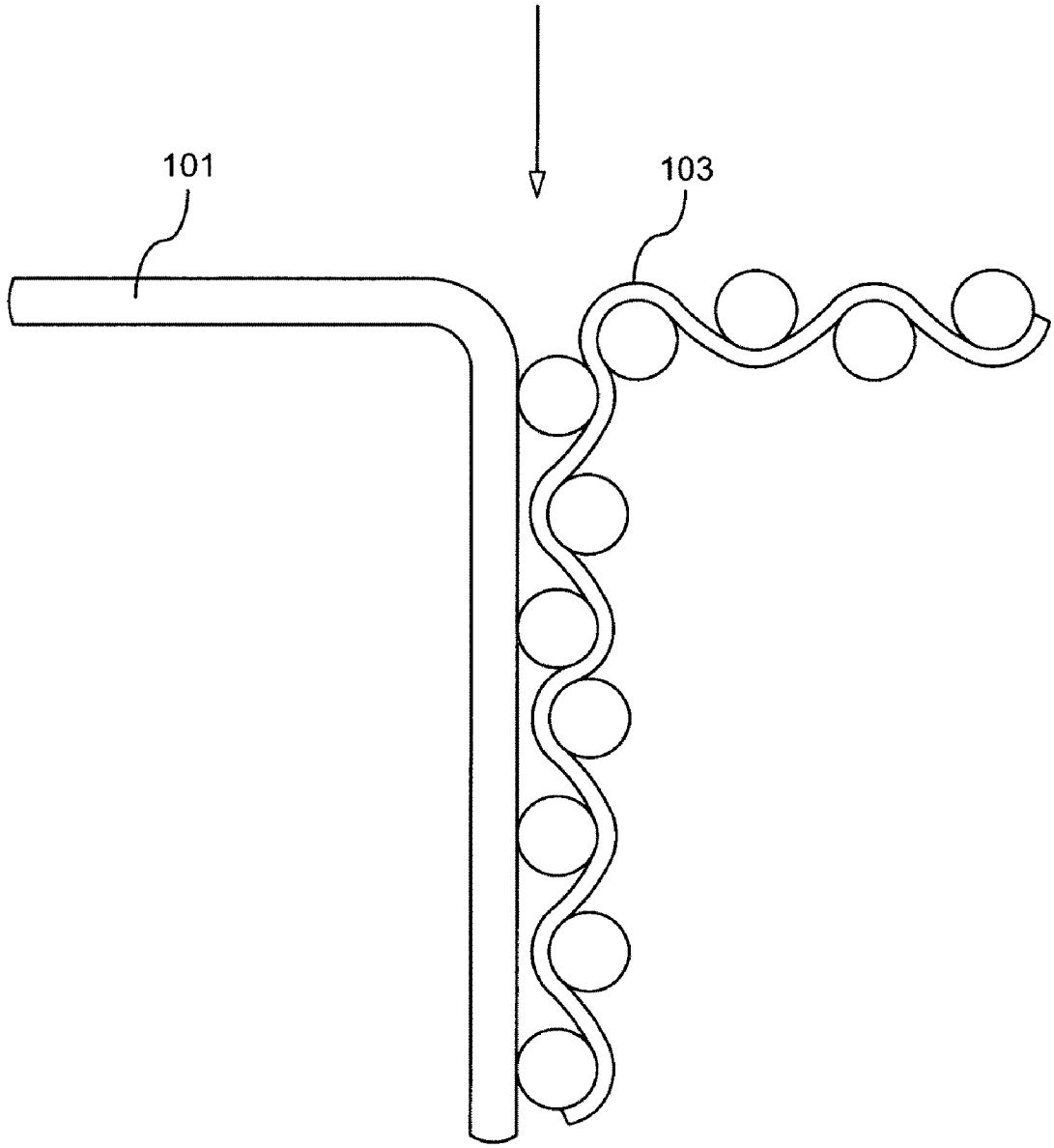

FIG. 41 is a schematic view of the sample orientation as described in more detail in the peel test contained herein.

Figure 42:
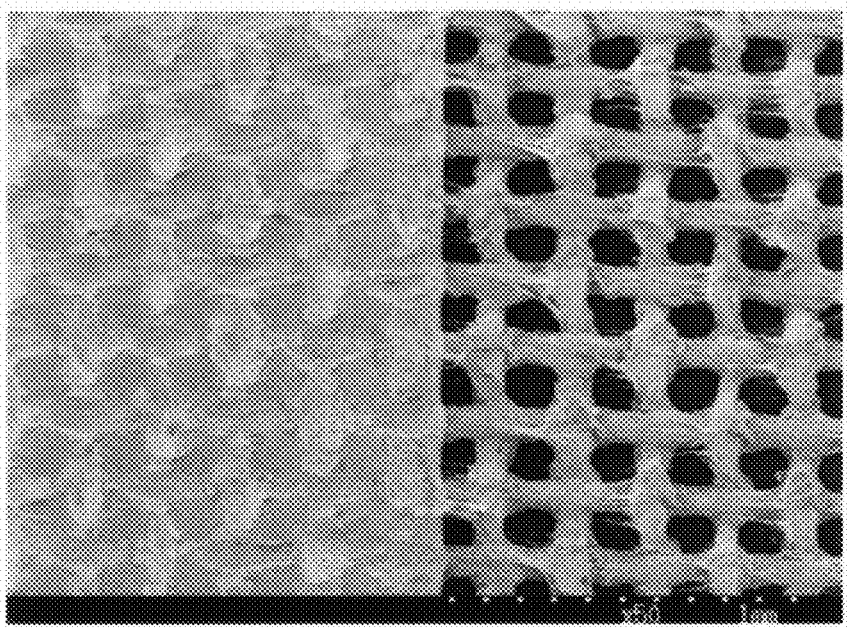

FIG. 42 is an SEM at 50× magnification of the surface of the article made in Example 12a after being subjected to the peel test.

Figure 43:
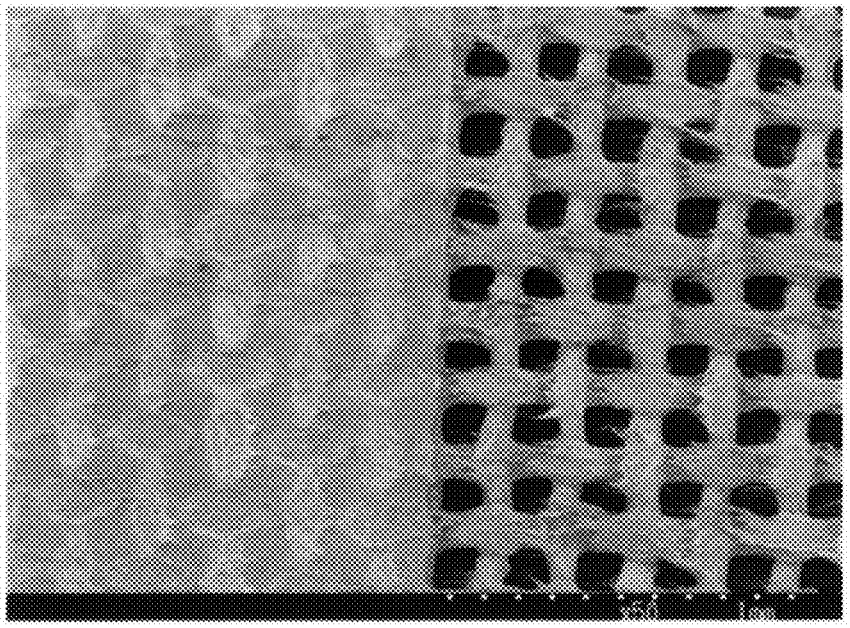

FIG. 43 is an SEM at 50× magnification of the surface of the article made in Example 12b after being subjected to the peel test.

Figure 44:
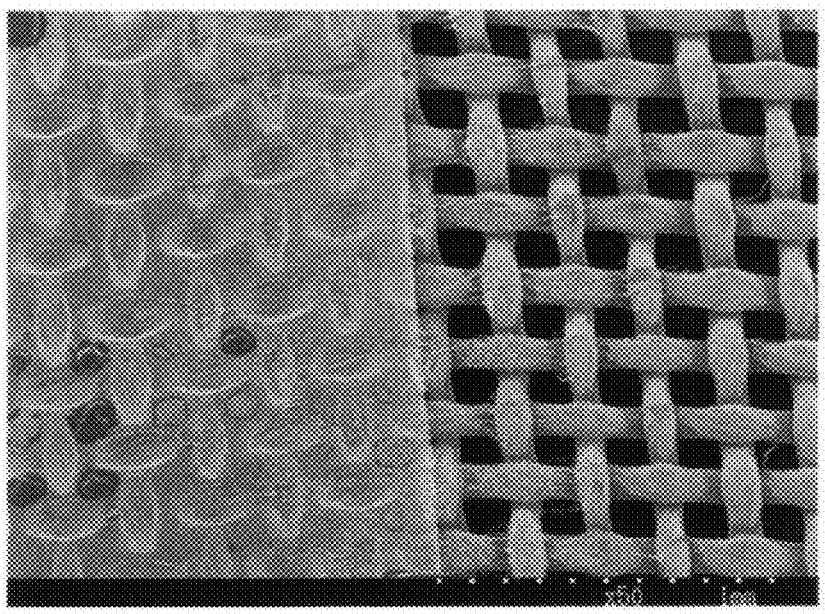

FIG. 44 is an SEM at 50× magnification of the surface of the article made in Comparative Example F after being subjected to the peel test.

Figure 45:
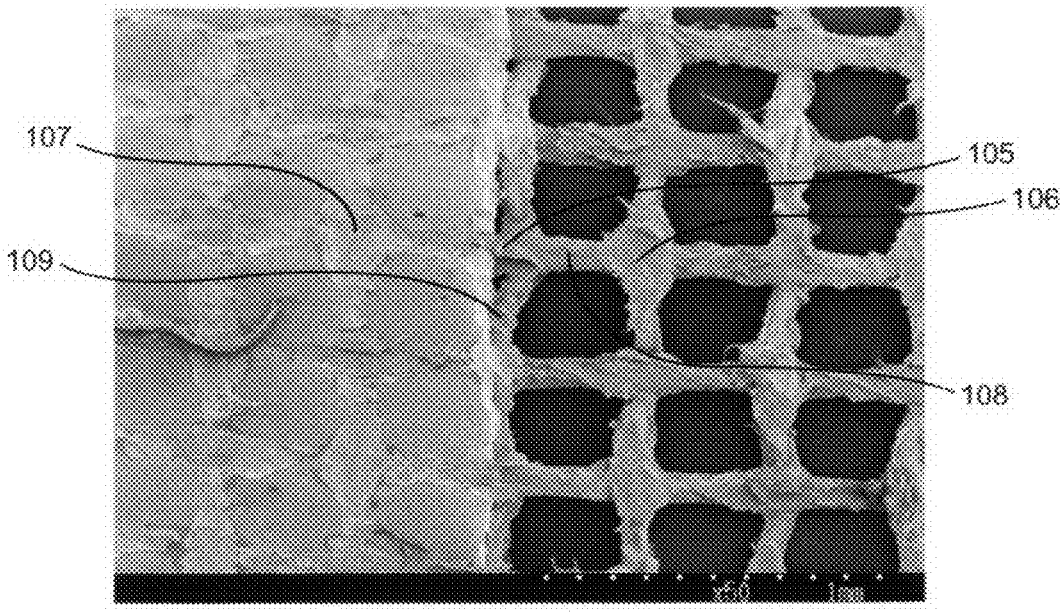

FIG. 45 is an SEM at 50× magnification of the surface of the article made in Example 13a after being subjected to the peel test.

Figure 46:
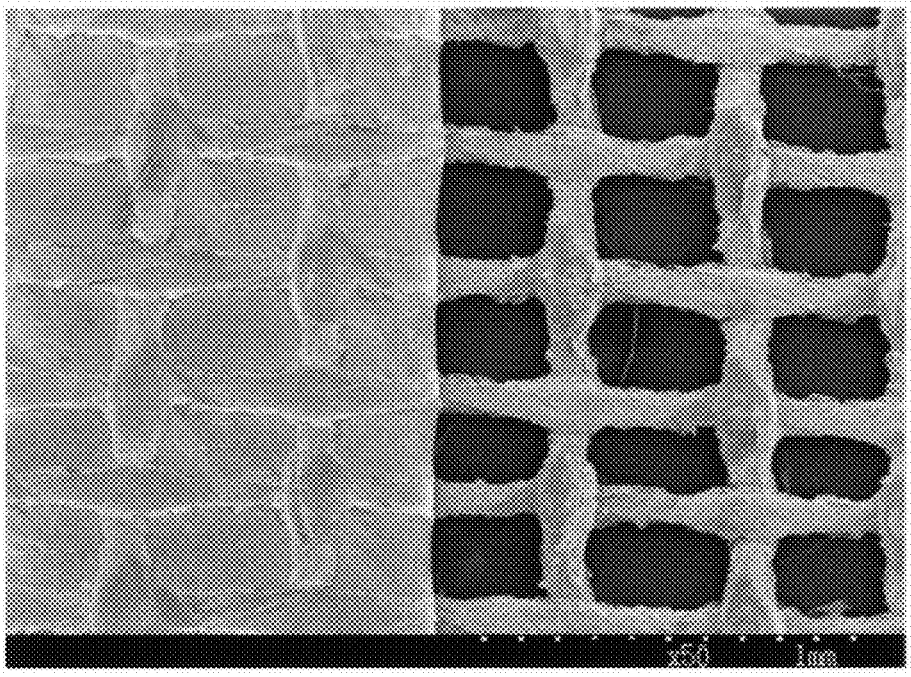

FIG. 46 is an SEM at 50× magnification of the surface of the article made in Example 13b after being subjected to the peel test.

Figure 47:
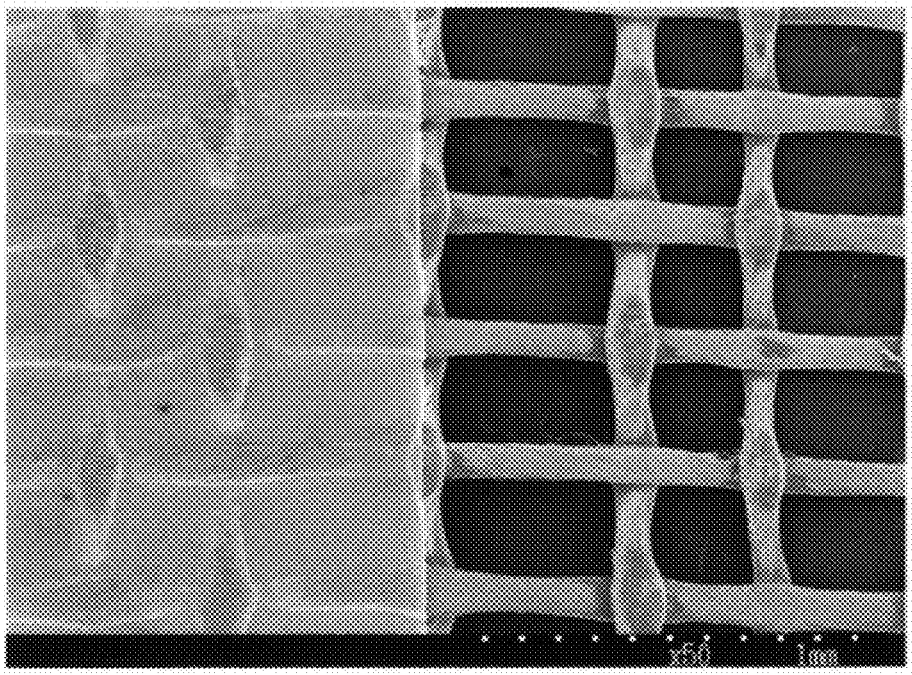

FIG. 47 is an SEM at 50× magnification of the surface of the article made in Comparative Example G after being subjected to the peel test.

Figure 48:
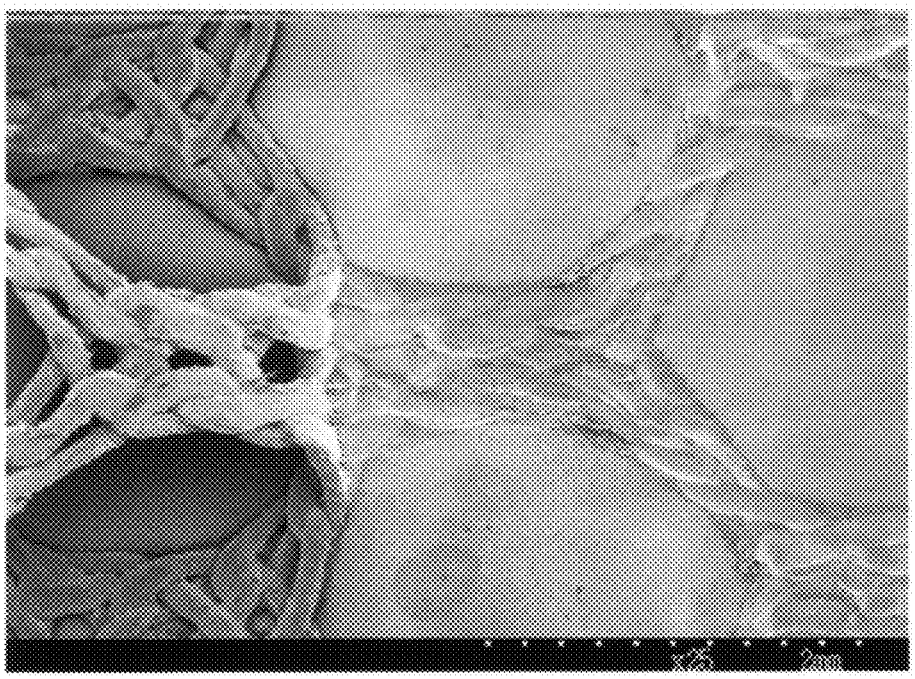

FIG. 48 is an SEM at 25× magnification of the surface of the article made in Example 14 after being subjected to the peel test.

Figure 49:
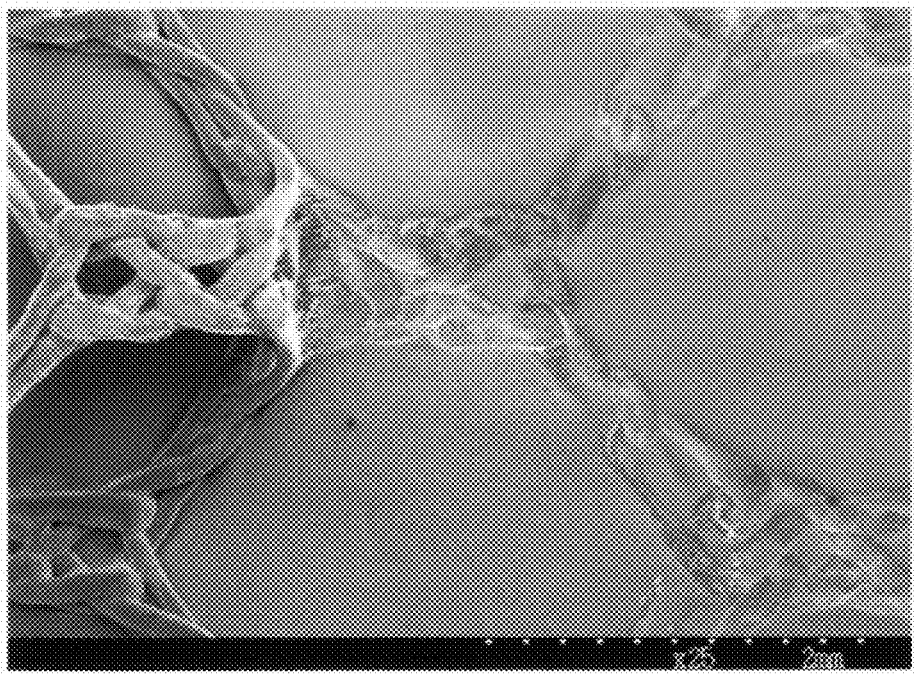

FIG. 49 is an SEM at 25× magnification of the surface of the article made in Comparative Example H after being subjected to the peel test.

Figure 50:
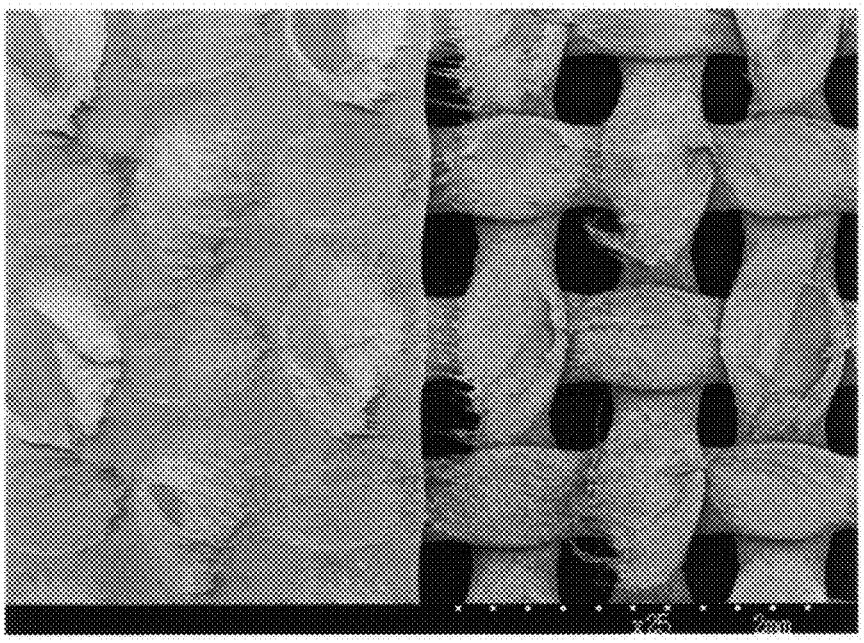

FIG. 50 is an SEM at 25× magnification of the surface of the article made in Example 15 after being subjected to the peel test.

Figure 51:
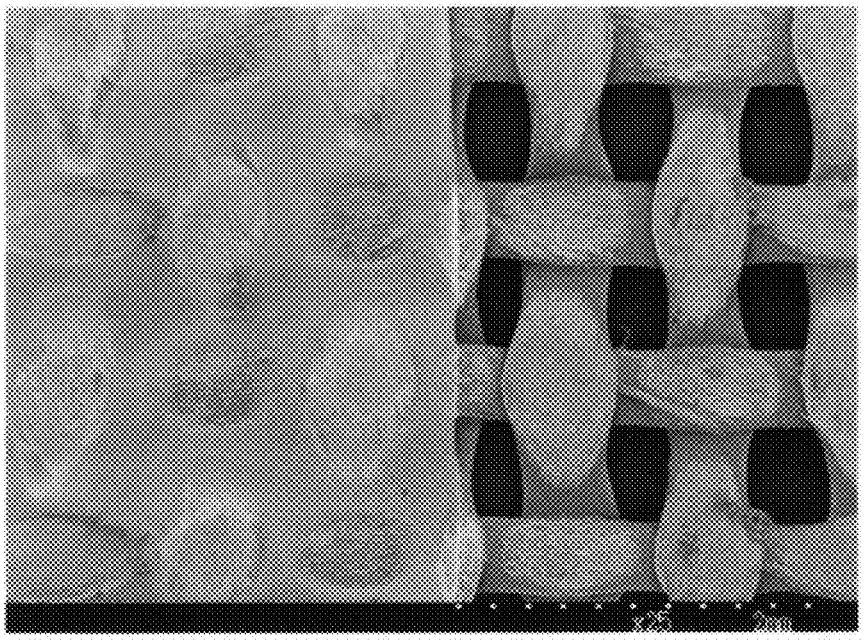

FIG. 51 is an SEM at 25× magnification of the surface of the article made in Comparative Example I after being subjected to the peel test.

Figure 52:
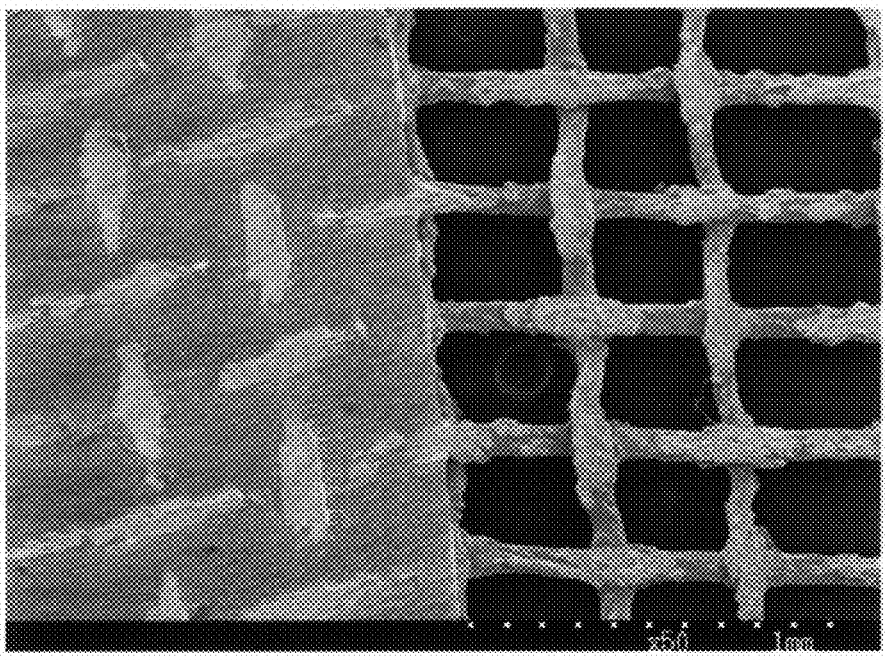

FIG. 52 is an SEM at 50× magnification of the surface of the article made in Example 16 after being subjected to the peel test.

Figure 53:
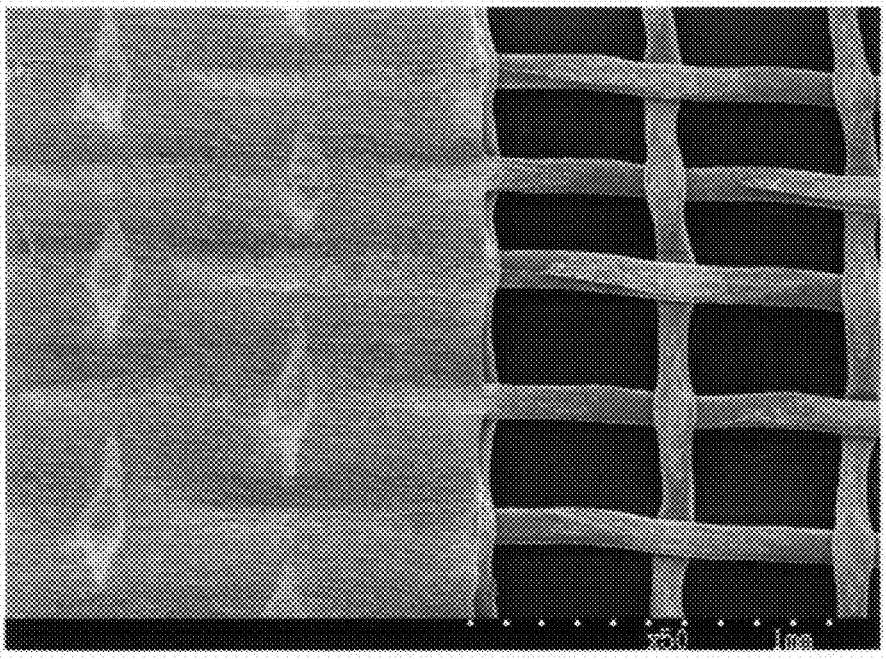

FIG. 53 is an SEM at 50× magnification of the surface of the article made in Comparative Example J after being subjected to the peel test.

Figure 54:
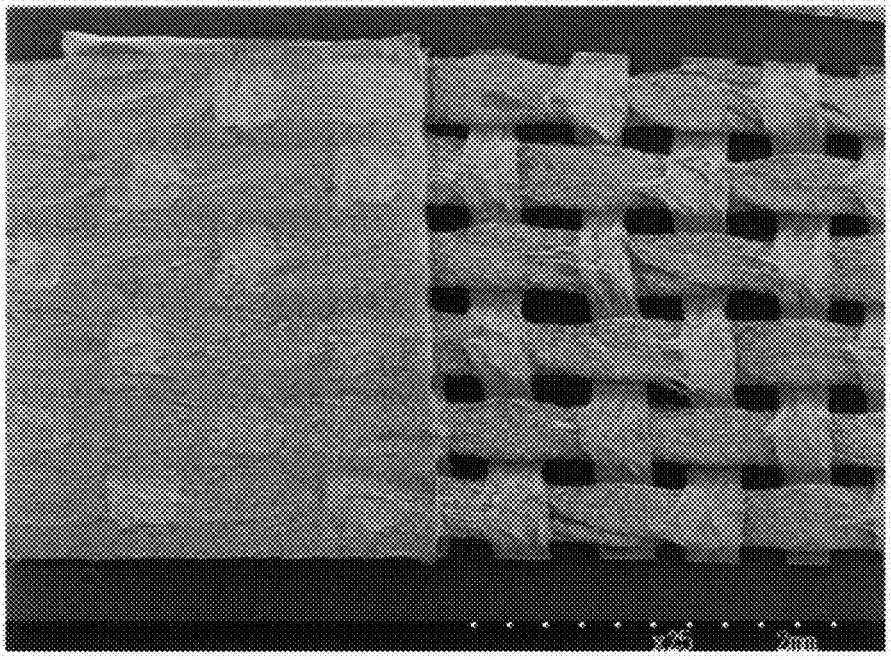

FIG. 54 is an SEM at 25× magnification of the surface of the article made in Example 17 after being subjected to the peel test.

Figure 55:
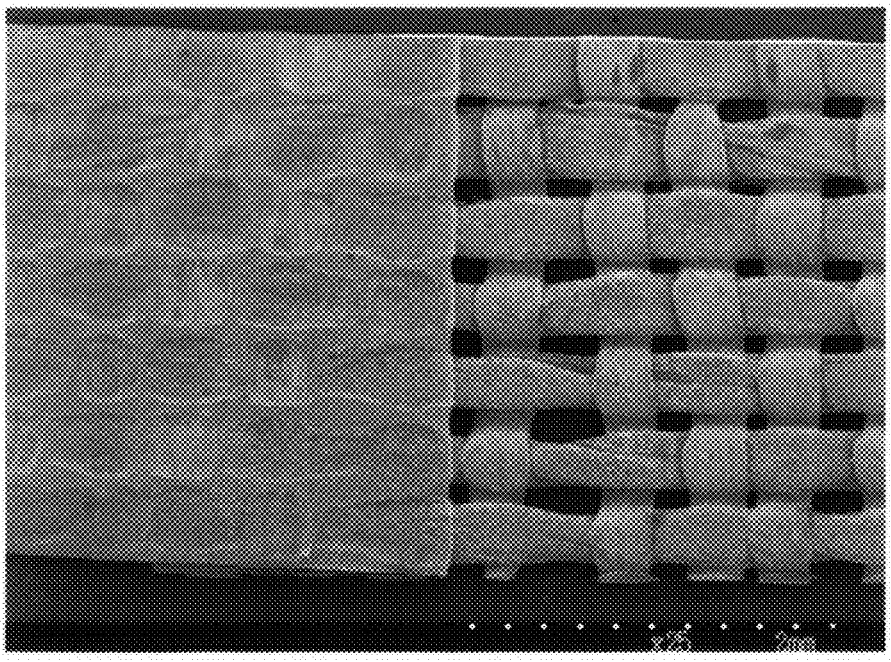

FIG. 55 is an SEM at 25× magnification of the surface of the article made in Comparative Example K after being subjected to the peel test.

FIG. 56 is a table that summarizes the process steps of each example.

Figure 57:
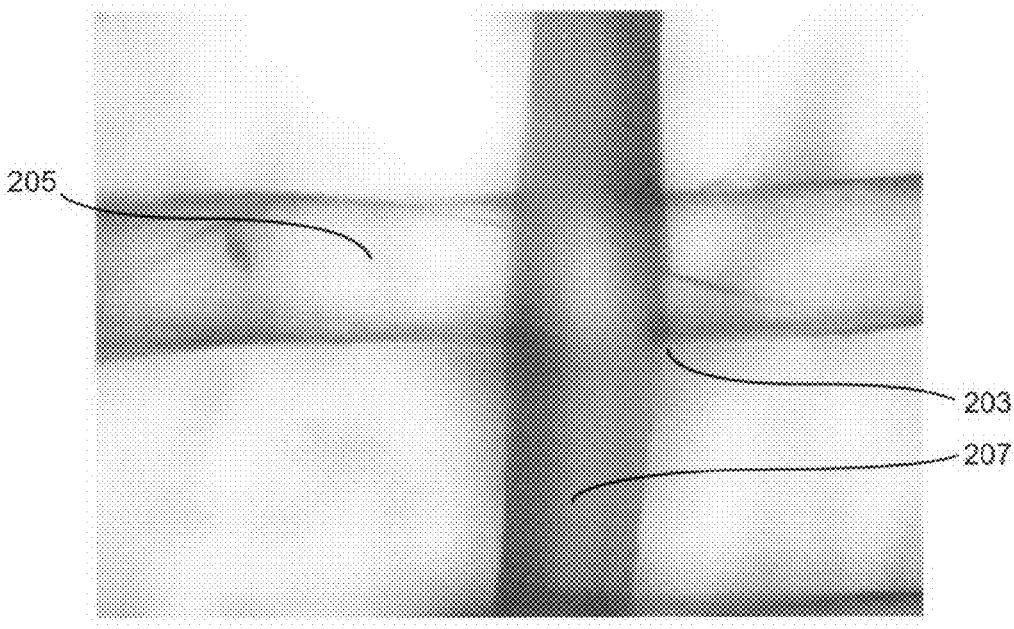
Figure 58:
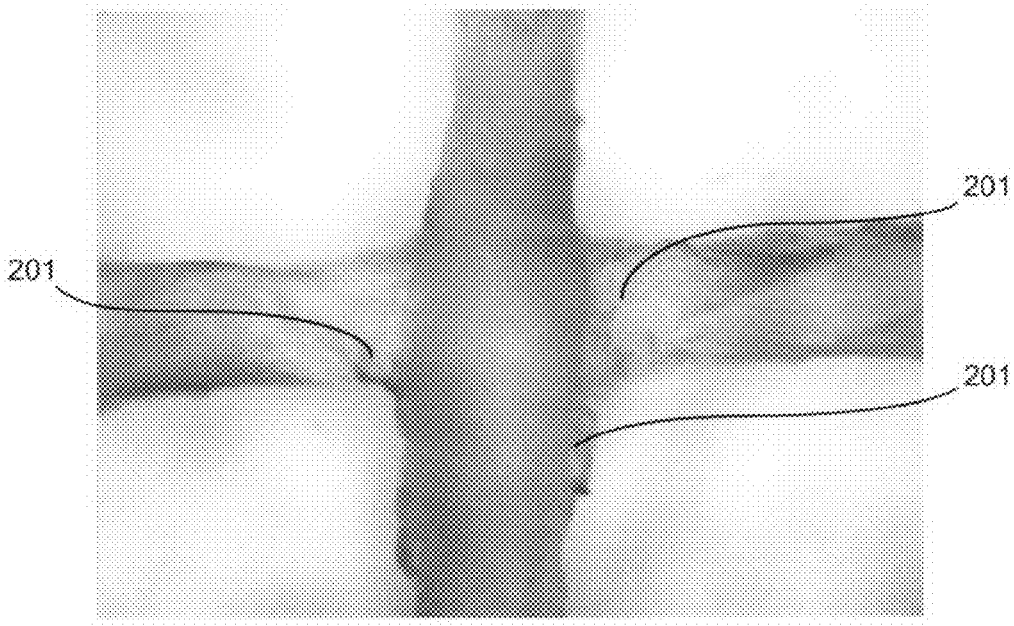
Figure 59:
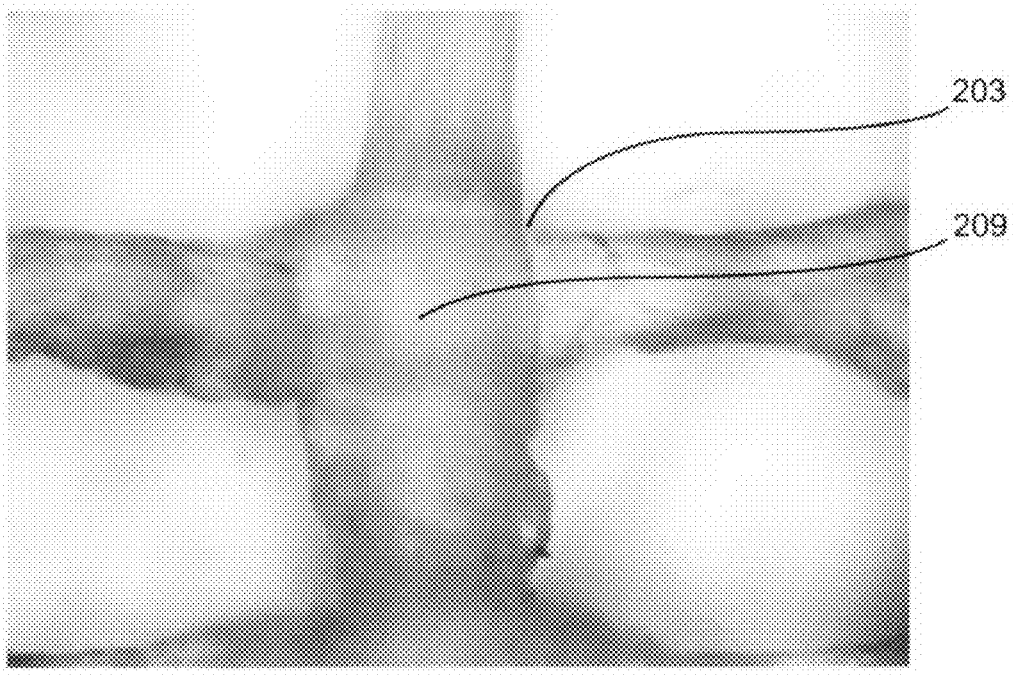

FIGS. 57-59 are sequential photographs at about 200× magnification taken from an optical microscope video recording of a plasma-treated ePTFE woven fiber mesh during a heating step, as described herein.

DETAILED DESCRIPTION OF THE INVENTION

The PTFE fabric articles of the present invention comprise a plurality of PTFE fibers overlapping at intersections, wherein at least a portion of the intersections have PTFE masses which extend from at least one of the intersecting PTFE fibers and mechanically lock the intersecting, or overlapping, fibers at the intersections. As used herein, the term PTFE fiber is intended to include any fiber that is comprised at least partially of PTFE, wherein the PTFE can be treated as taught herein. These masses provide the PTFE fabrics with enhanced mechanical stability heretofore unavailable in PTFE fabrics to resist fraying, deformation, etc., and embodiments of the invention may be constructed in a vast array of types and shapes of articles. For example, alternative embodiments of the invention may be constructed incorporating fibers in geometries including, but not limited to, twisted, round, flat and towed fibers, whether in monofilament or multifilament configurations. Additionally, fabrics of the invention may be in the form of sheets, tubes, elongated articles, and other alternative three-dimensionally shaped embodiments. Further, one or more filler materials may be incorporated into or with the PTFE structures. Alternatively, the PTFE fabrics may be incorporated as one or more layers of multi-layered structures.

In a first embodiment, the unique process of the present invention comprises first subjecting the PTFE fibers to a high-energy surface treatment, such as plasma treating. The plasma-treated PTFE fibers are then incorporated into a fabric with overlapping fibers, whether in the form of one or more woven, knitted, non-woven, laid scrim construction, or some combination thereof. Depending on the desired properties of the finished article, the plasma treated fibers may preferentially be oriented within the fabric. For example, in the case of a woven fabric, the plasma-treated fibers may be oriented in only the warp or weft directions, or in both directions. Additional types of fibers may also be incorporated into the fabric. The resulting fabric is subsequently heated to achieve the unique PTFE structures with PTFE masses extending from one or more of the underlying intersecting fibers at the fiber intersections. Additionally, the non-intersecting portions may exhibit islands of PTFE which are attached to and extend from the underlying expanded PTFE structure.

In a second, alternative embodiment, the unique process of the present invention can comprise first forming a precursor PTFE fabric with overlapping PTFE fibers at intersections, whether in the form of one or more woven, knitted, non-woven, laid scrim construction, or some combination thereof; subjecting the precursor PTFE fabric or structure to a high-energy surface treatment; then following with a heating step to achieve the unique PTFE structures with PTFE masses extending from one or more of the underlying intersecting fibers at the fiber intersections. Additionally, the non-intersecting portions may exhibit islands of PTFE which are attached to and extend from the underlying expanded PTFE structure.

Solely for convenience, the term "plasma treatment" will be used to refer to any high-energy surface treatment, such as but not limited to glow discharge plasma, corona, ion beam, and the like. It should be recognized that treatment times, temperatures and other processing conditions may be varied to achieve a range of PTFE masses and PTFE island sizes and appearances. For example, in one embodiment, the PTFE fabric can be plasma etched in an argon gas or other suitable environment, followed by a heat treating step. Neither heat treating the PTFE structure alone nor plasma treating alone without subsequent heat treating results in articles of the present invention.

FIGS. 57 through 59 are photographs captured from a video recording taken of a plasma-treated ePTFE woven fiber mesh during the subsequent heating step, as described in accordance with the teachings of Example 1a, herein. An optical microscope (Optiphot BF/DF, Nikon Inc., Melville, N.Y.) was used at approximately 200× magnification. A heating stage (Linkam THMS600, Linkam Scientific Instruments Ltd Tadworth, Surrey, UK) was used to support and heat the woven fiber mesh to about 360° C. The initial fiber diameter of the fibers was about 75 microns. These figures show, in sequence, the formation of PTFE islands 201 and migration of the PTFE islands 201 toward the intersection 203 of two fibers, 205, 207, to form a mass 209 at the intersection 203 which locks the two fibers 205, 207 together at the intersection 203. FIG. 57 shows the intersection 203 of the two fibers 205, 207 of the plasma-treated woven fabric prior to heating. FIG. 58 shows an intermediate stage of heating wherein islands 201 are forming and migrating toward the intersection 203 to form a mass. FIG. 59 shows the fully formed mass 209 at the intersection 203. As noted with respect to FIG. 59, for example, the presence of the masses at the intersections can be confirmed by visual means, including but not limited to techniques such as optical and scanning electron microscopy or by any other suitable means. The presence of PTFE in the masses can be determined by spectroscopic or other suitable analytical means. As used herein, the term mechanical stability is intended to refer to the capacity of an object to resist deformation from its original position or to return to its original position when subjected to a deforming force. The mechanical stability is manifested by the locking of the PTFE fibers to one another at the intersections. This enhanced mechanical stability enables articles of the present invention to resist fraying as well as to substantially resist reorientation of the PTFE fibers upon the application of external forces. Mechanical stability is a critical feature in products in which the size and shape of the fiber arrangement of the articles are important to the optimal performance. Such products include those, such as chlor-alkali membranes, wherein the article provides a mechanically stable substrate. Precision woven products and other precision fabric articles also require the mechanical stability afforded by articles of the present invention.

A fiber removal test may be used to demonstrate the enhanced fray resistance of these unique materials. Other mechanical performance enhancements of these unique materials may include, but are not limited to improved dimensional stability, bending, tear, ball burst and abrasion characteristics. For example, conventional PTFE fabrics, including precursor articles used in the formation of articles of the present invention, are prone to fraying. This problem is exacerbated due to the lubricious nature of PTFE fibers. This may be demonstrated by simply cutting the fabric with a pair of scissors. Alternatively, this phenomenon can be demonstrated, for instance, by inserting a pin between the fibers of a conventional PTFE fabric, near a free edge of the fabric. Minimal force is required to dislodge and remove an intact fiber upon the application of a tensile force as performed in a fiber removal test, described later herein.

When the same procedures are followed with an article of the present invention, when cut with scissors, the inventive structures are virtually free of frayed fibers. When performing a fiber fray test on the inventive materials, significantly more force is required, enough so as to either break fibers or break the bond provided by the mass of PTFE at the crossover points. The fray resistance of articles of the invention can be determined based on a result where either broken fibers are observed and/or the removal of a fiber with remnants of the mass at the crossover points still attached to the fiber are observed.

As noted earlier herein, a wide variety of shapes and forms of structures including, but not limited to, sheets, tubes, elongated articles and other three-dimensional structures can be formed by following the inventive process to provide greater mechanical stability. In one embodiment, the starting PTFE fabric structures may be configured into a desired final three-dimensional shape prior to subjecting them to the plasma and subsequent heating steps. In an alternative embodiment, the starting PTFE fabric structures can be so treated, then manipulated further, as needed, to create the shapes and forms described above.

The portions of PTFE fibers that are not part of intersections may have a microstructure characterized by nodes interconnected by fibrils, and have raised islands comprising PTFE extending from the PTFE fibers. The masses at intersections in articles of the present invention exhibit a characteristic surface appearance, in which the masses typically extend between overlapping fibers. Islands may or may not be connected to masses. The most surprising result, however, is the dramatic increase in mechanical stability of the inventive article afforded by plasma treatment followed by heat treatment when compared to prior art articles subjected only to a heat treatment.

Whereas a variety of PTFE materials can be utilized in the practice of the invention, in embodiments where ePTFE fiber is used, the ePTFE fibers provide the final articles with the enhanced properties attributable to the expanded PTFE, such as increased tensile strength as well as pore size and porosity that can be tailored for the intended end-use of the product. Furthermore, filled ePTFE fibers can be incorporated and used in the practice of the invention.

In another embodiment of the invention, reinforced membranes possessing exceptional peel strength and dimensional stability can be achieved. A combination of plasma-treatment and heat treatment, either prior to or during bonding, allows the formation of laminates of fabrics comprising ePTFE or ePTFE/perfluoralkoxy (PFA) blended fibers bonded to PTFE membranes without the use of an adhesive. These unique laminates possess heretofore unobtainable peel strengths, thus alleviating problems inherent to prior art materials, such as catastrophic failure due to delamination of the fabric from the membrane and other failure modes. Additionally, since no added adhesives are used, the reinforced membrane is comprised entirely of PTFE and the performance of the resulting reinforced membrane is not compromised as described earlier herein with respect to prior art materials.

The fabric of the laminate may be formed from knitted, woven or felted fibers, perforated sheet, etc., and may comprise a variety of ePTFE fiber or expanded PTFE/PFA blended fibers or sheets, depending on the desired end structure. In the case of fibers, the precursor fibers can range from highly porous (i.e., possessing densities as low as 0.7 g/cc or lower) to substantially non-porous. The reinforced membrane can be in the shape of a flat sheet, a curved sheet (which could be made, for example, by bonding the fabric and membrane together on a round mandrel), or a variety of other three-dimensional shapes.

Alternatively, bonding can be achieved by processes which include, but are not limited to, plasma treating then heat treating the fabric, followed by hot compressing the fabric and membrane together, or by plasma treating the fabric followed by hot compressing the fabric and membrane together, or the like. A wide range and combination of plasma treatment and subsequent heat treating steps can be used to achieve the desired effect. The preferred conditions create a laminate wherein the fabric exhibits a plurality of PTFE fibers overlapping at intersections, wherein at least a portion of the intersections have PTFE masses extending from at least one of the intersecting PTFE fibers and lock together the intersecting, or overlapping, fibers at the intersections. The preferred hot compression conditions are those wherein the fabric and membrane are exposed to sufficiently high temperatures, at high enough pressures, for a long enough period of time, to create a strong bond between the layers without compromising the desired performance (e.g., filtration, etc.) of the laminate. The temperature is preferably within the range of 327 deg C. and 400 deg C., and more preferably within the range of 350 deg C. and 380 deg C.

The choice of preferred plasma treatment, heat treatment conditions, and hot compression conditions can vary depending on the desired characteristics of the resulting laminate structures.

The present invention will be described further with respect to the non-limiting Examples provided below.

TEST METHODS

Fray Resistance Via Fiber Removal Test

Fine-tipped tweezers were used to pull away one or more fibers from an edge of a fabric sample at an approximately 45 degree angle relative to the fabric surface. Pulling was carried out until the fiber(s) separated from a portion of the fabric, thus creating a frayed edge. The separated fiber(s) were adhered to a double-sided adhesive tape, the other side of which had been previously adhered to a stub. The frayed edge was also adhered to the adhesive tape. The sample was then examined using a scanning electron microscope. Mechanical locking of overlapping fibers can be determined based on an evaluation of scanning electron micrographs, or other suitable magnified examination means, and a positive result is achieved where either broken fibers are observed and/or the removal of a fiber with remnants of the mass at the crossover points still attached to the fiber are observed. The presence of these remnants indicates mechanical locking by the masses at the fiber crossover points in the fabric, i.e., fray resistance. The absence of these remnants demonstrates the lack of mechanical locking at the fiber crossover points in the fabric and, hence, the propensity to fray.

Peel Test

Peel tests were performed using a peel tester (IMASS SP-2000, IMASS, Inc., Accord, Mass.).

In order to minimize necking of the sample during the test, a 6.4 cm wide strip of masking tape (Highland 2307 tape, 3M, Inc., Minneapolis, Minn.) was applied to the woven side of each reinforced membrane in the warp direction of the woven fabric. A 3.8 cm wide peel test sample was cut along the warp direction of each reinforced membrane.

The sample was placed in T-peel fixture. The test length of the sample was 5.7 cm and the test was performed at 30.5 cm/min. Three measurements were made for each laminate. The values were averaged and reported as the peel strength.

Scanning electron micrographs were taken of each peel test sample. FIG. 41 demonstrates the orientation of the sample during peel testing. The arrow in this figure indicates the view of the SEMs, i.e., the surfaces of the peeled sample, including peel interface. In this way, the bonded sides of both the membrane 101 and the fabric 103 were captured in the same image.

EXAMPLES

Example 1a

Nominal 90 denier ("d") ePTFE round fiber was obtained (part # V112403; W.L. Gore & Associates, Inc., Elkton, Del.) and woven into a structure having the following properties: 31.5 ends/cm in the warp direction by 23.6 picks/cm in the weft direction.

This woven article was plasma treated with an Atmospheric Plasma Treater (model number ML0061-01, Enercon Industries Corp., Menonomee Falls, Wis.) using argon gas. The process parameters were: argon flow rate of 50 L/min, power source of 2.5 kW, line speed of 3 m/min, 7.6 cm electrode length, 10 passes. The woven plasma treated article was restrained on a pin frame and placed in a forced air oven (model number CW 7780F, Blue M Electric, Watertown, Wis.) set to 350 deg C. for 30 min.

Figure 1:
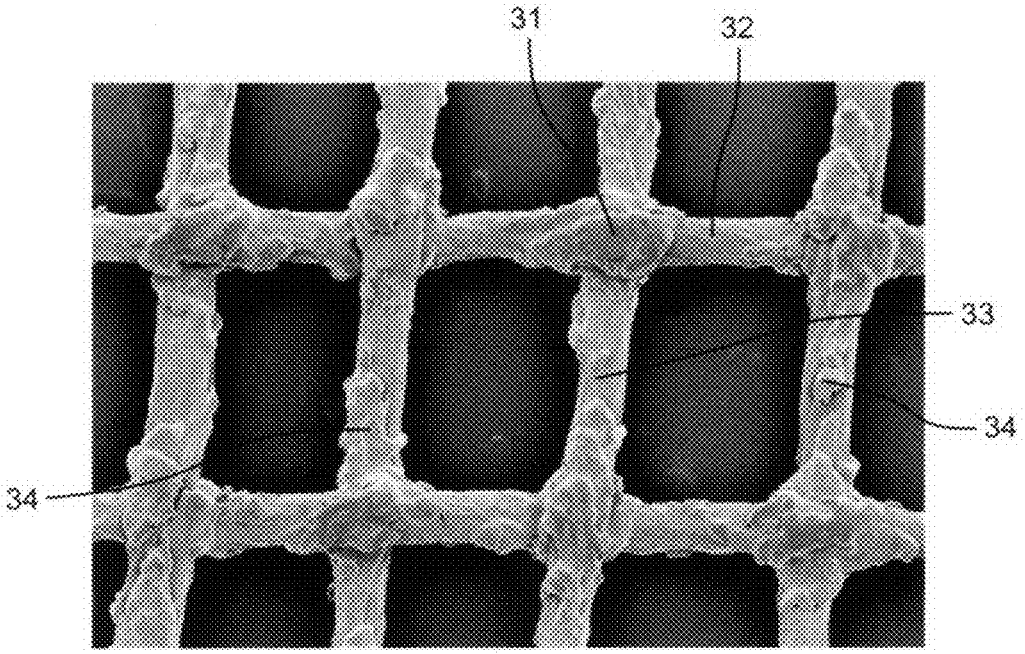
Figure 2:
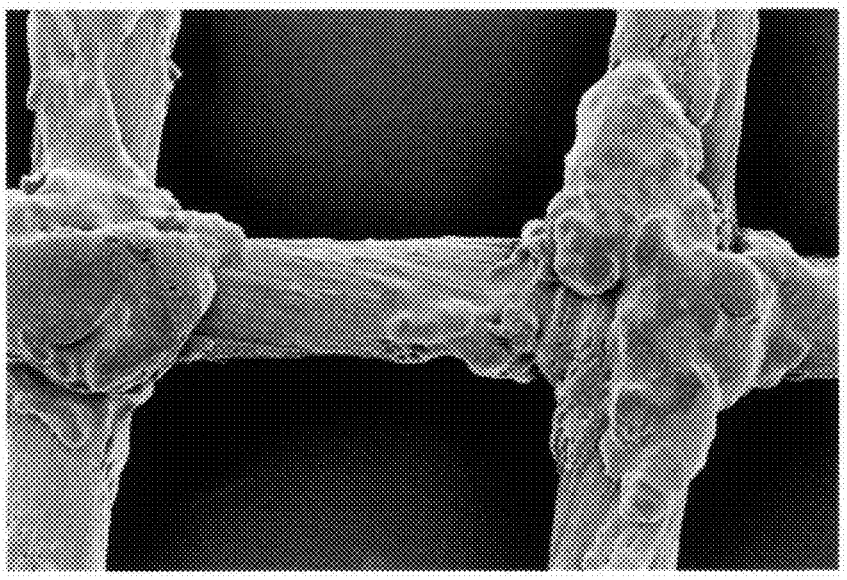
Figure 3:
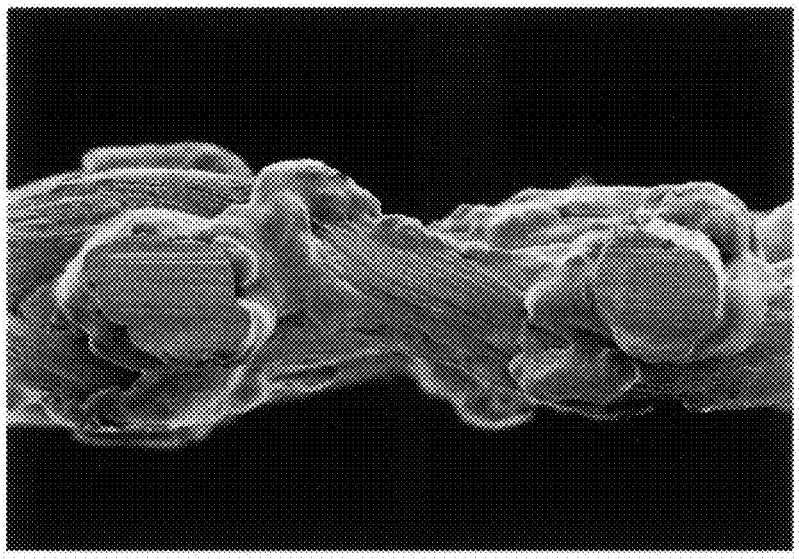
Figure 4:
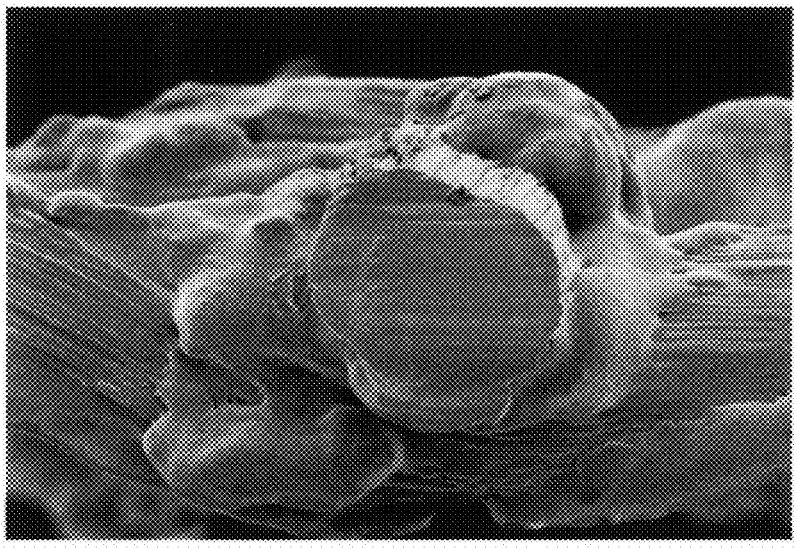

The article was removed from the oven and quenched in water at ambient temperature, then it was examined with a scanning electron microscope. Scanning electron micrographs ("SEMs") of the surface of this article appear in FIGS. 1 and 2 at magnifications of 100× and 250×, respectively. In these, and every other scanning electron micrograph, the length indicated in the lower right of the photograph corresponds to the distance between the first dot and the last dot of the scale bar that appears directly above the length value. Scanning electron micrographs of the cross-section of this article appear in FIGS. 3 and 4 at magnifications of 250× and 500×, respectively. As shown in FIG. 1, PTFE masses 31 extend from at least one of the intersecting PTFE fibers 32 and 33. PTFE islands 34 are present on the surface of the fibers.

Figure 28:
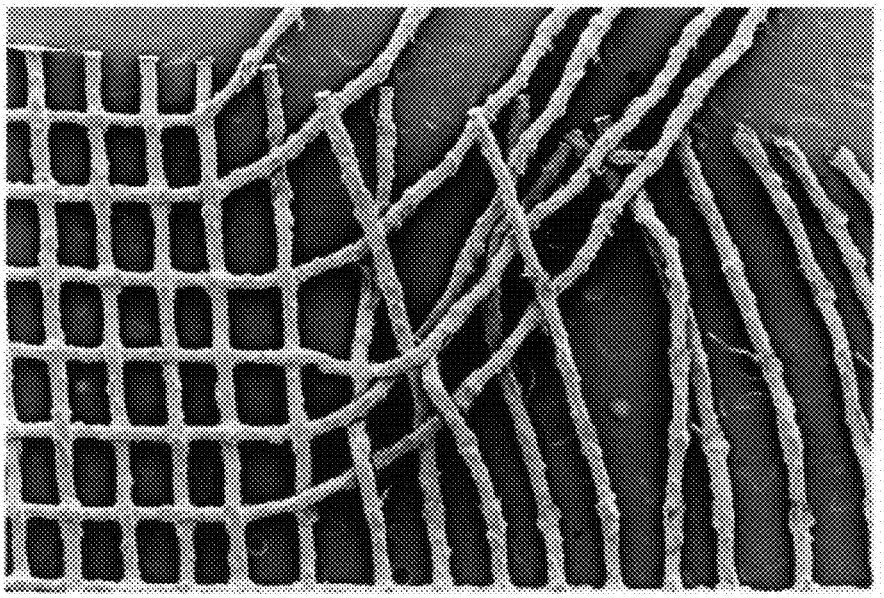
Figure 29:
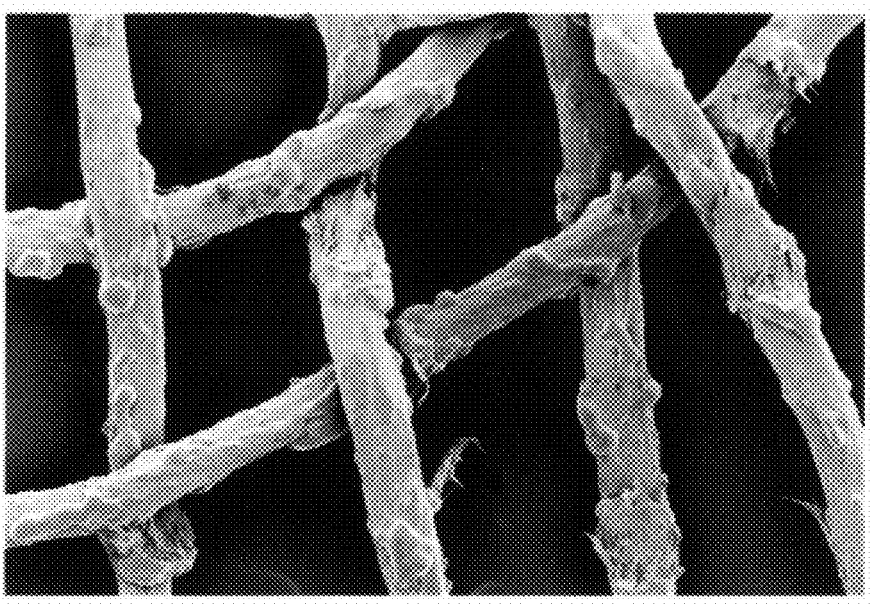
Figure 30:
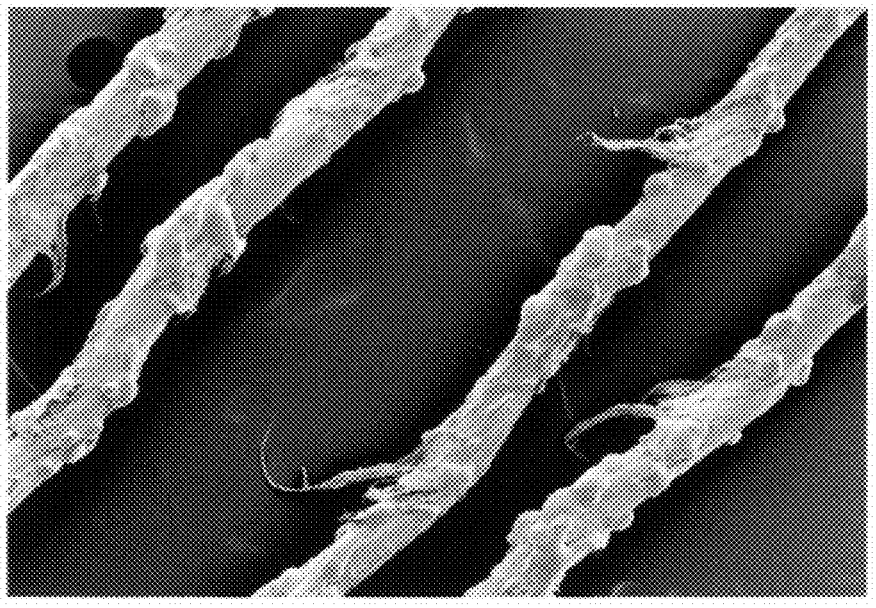
Figure 31:
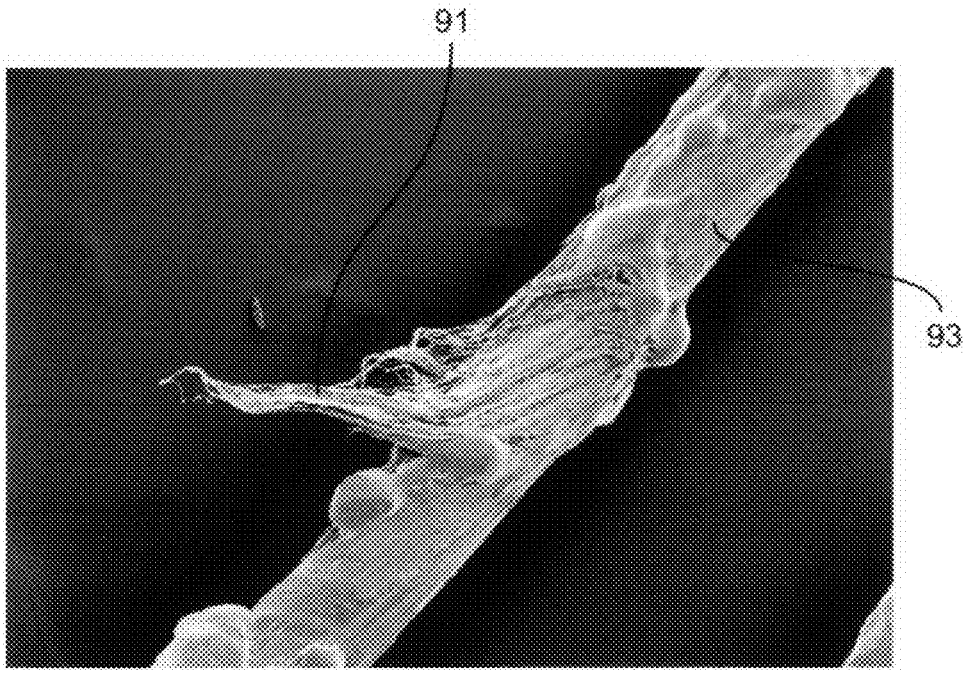

The fray resistance of this structure was demonstrated via the fiber removal test, described above, and results are shown in FIGS. 28-31. Specifically, FIGS. 28 and 29 show SEMs of the fabric of this example at magnifications of 25× and 100×, respectively, after fibers had been teased from the fabric. FIGS. 30 and 31 show SEMs of the fibers of the fabric of this example at magnifications of 100× and 250×, respectively, after the fibers had been removed from the fabric. The hair-like material 91 extending from the fibers 93 had previously comprised a portion of a mass at an intersection of fibers, as is shown in FIG. 32.

The SEMs demonstrate that upon removal of the fibers from the woven article, portions of the PTFE masses at the intersections remained attached to the fibers. That is, the removed fibers exhibit the presence of hair-like material due to the disruption of the masses at the intersections. Accordingly, fray resistance was demonstrated.

Example 1b

Nominal 90d ePTFE round fiber was obtained (part # V112403; W.L. Gore & Associates, Inc., Elkton, Del.), and a woven structure was formed with this fiber having the following properties: 31.5 ends/cm in the warp direction by 23.6 picks/cm in the weft direction.

The woven article was plasma treated with an Atmospheric Plasma Treater (model number ML0061-01, Enercon Industries Corp., Menonomee Falls, Wis.) using argon gas. The process parameters were: argon flow rate of 50 L/min, power source of 2.5 kW, line speed of 3 m/min, 7.6 cm electrode length, 10 passes.

The woven plasma treated article was restrained on a pin frame and placed in a forced air oven (model number CW 7780F, Blue M Electric, Watertown, Wis.) set to 350 deg C. for 15 min. The article was removed from the oven and quenched in water at ambient temperature, then the article was examined with a scanning electron microscope and tested for resistance to fraying (fiber removal) in accordance with the test methods described above.

Figure 5:
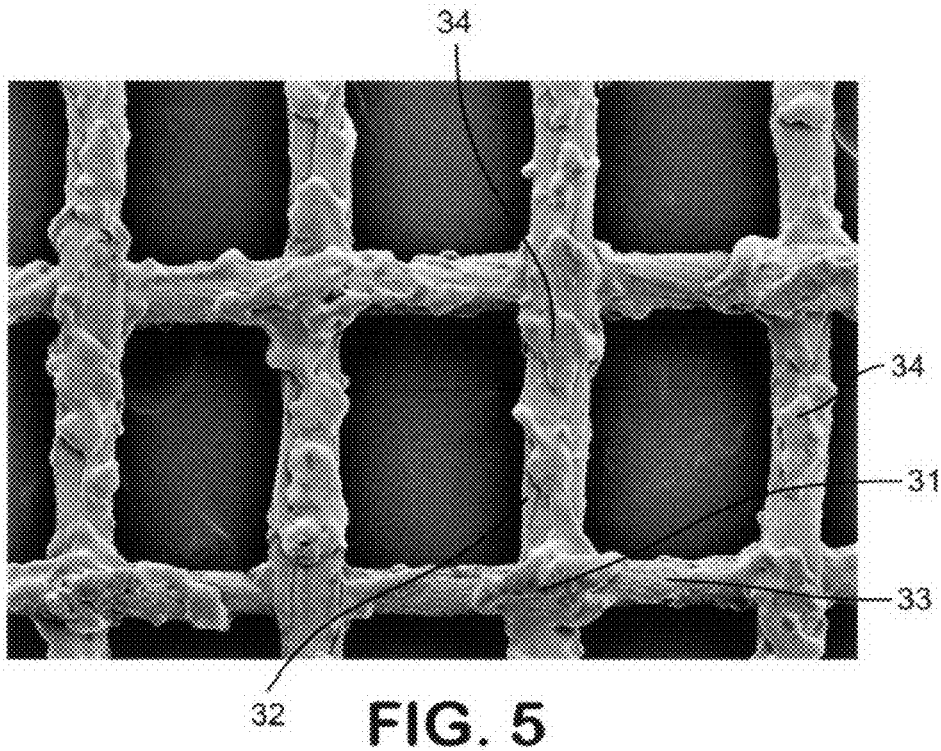
FIG. 5 is an SEM at 100× magnification of the surface of the article made in Example 1b.
Figure 6:
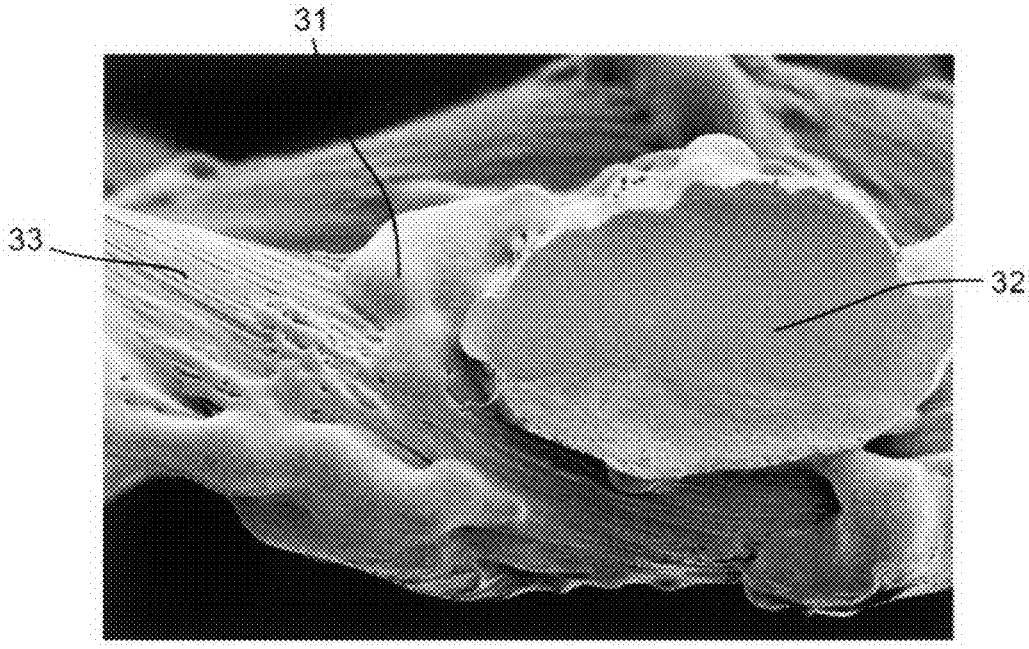
FIG. 6 is an SEM at 500× magnification of the cross-section of the article made in Example 1b.

Scanning electron micrographs of the surface and cross-section of this article appear in FIGS. 5 and 6, respectively, at magnifications of 100× and 500×, respectively.

As shown in FIG. 5, PTFE masses 31 extended from at least one of the intersecting PTFE fibers 32 and 33. PTFE islands 34 are present on the surface of the fibers.

The fray resistance fiber removal test results were as follows. FIG. 32 shows an SEM of the fabric of this example at a magnification of 25× after fibers had been teased from the fabric. FIG. 33 shows an SEM of a fiber of the fabric of this example at a magnification of 250× after this fiber had been teased out of the fabric. The hair-like material extending from the fiber had previously comprised a portion of the mass at an intersection of fibers.

The SEMs demonstrate that upon removal of the fibers from the woven article, portions of the PTFE masses which had been present at the intersections remained attached to the fibers. That is, the removed fibers exhibit the presence of hair-like material due to the disruption of the mass at the intersection. Thus, fray resistance was demonstrated.

Comparative Example A

Nominal 90d ePTFE round fiber was obtained (part # V112403; W.L. Gore & Associates, Inc., Elkton, Del.), and a woven article was formed with this fiber having the following properties: 31.5 ends/cm in the warp direction by 23.6 picks/cm in the weft direction.

The woven article was restrained on a pin frame placed in a forced air oven set to 350 deg C. for 30 min. The article was removed from the oven and quenched in water at ambient temperature. The article was examined with a scanning electron microscope and tested for fraying (fiber removal) in accordance with the test methods described above.

Figure 7:
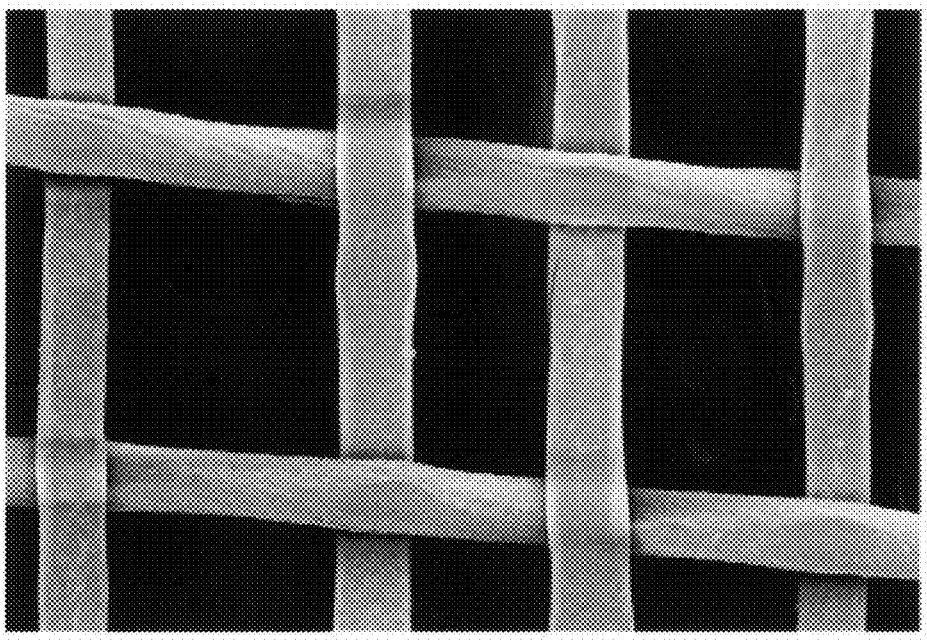
FIGS. 7 and 8 are SEMs at 100× and 250× magnifications, respectively, of the surface of the article made in Comparative Example A.
Figure 8:
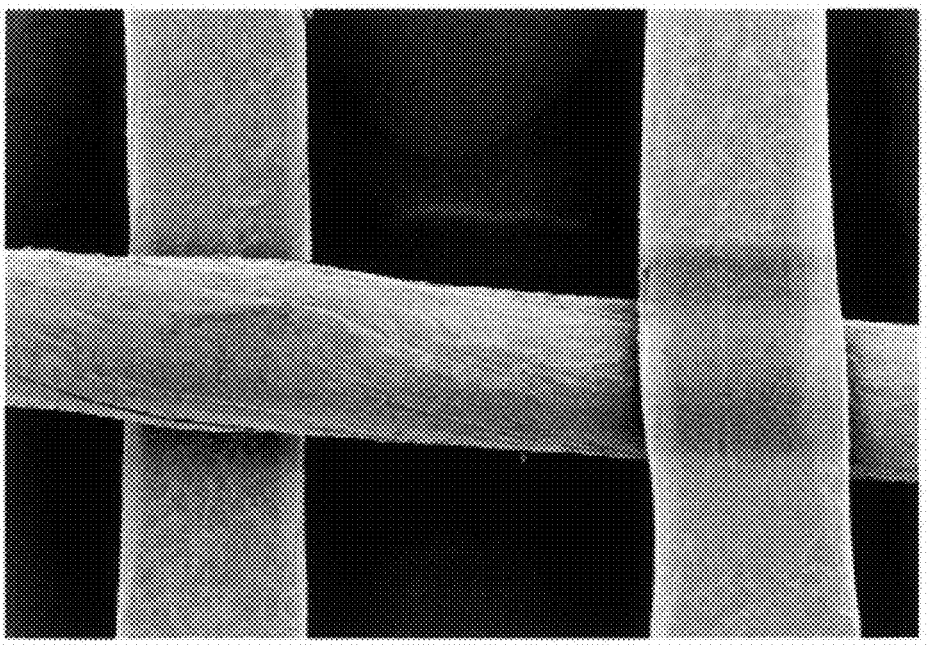
Figure 9:
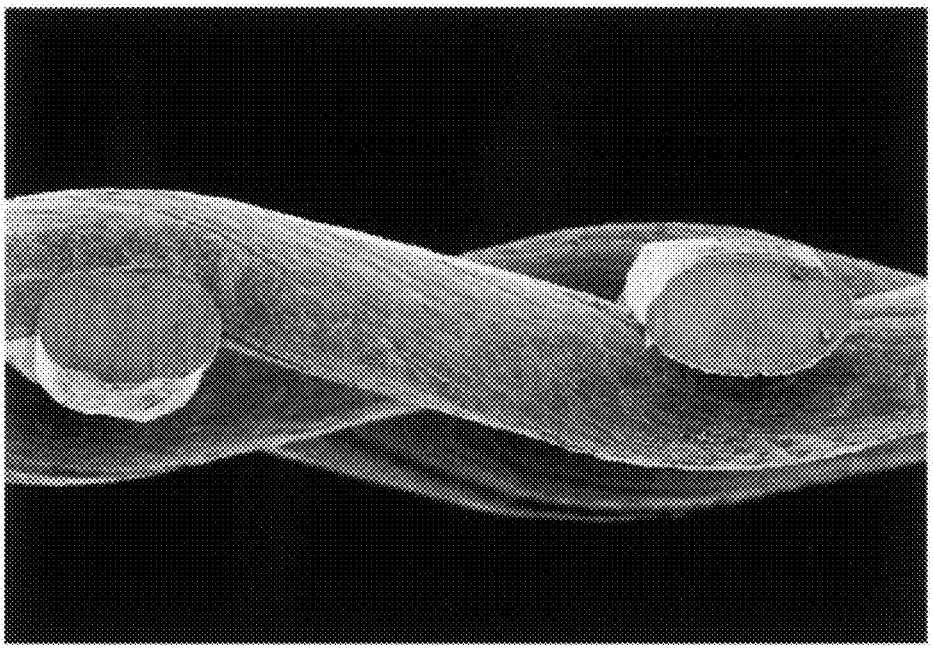
FIGS. 9 and 10 are SEMs at 250× and 500× magnifications, respectively, of the cross-section of the article made in Comparative Example A.
Figure 10:
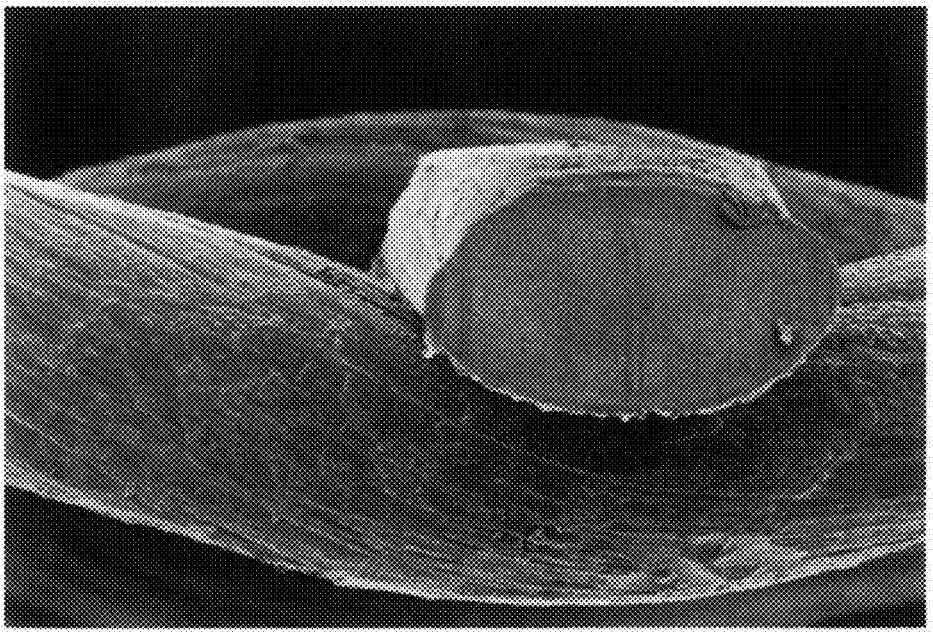

Scanning electron micrographs of the surface of this article appear in FIGS. 7 and 8 at magnifications of 100× and 250×, respectively. Scanning electron micrographs of the cross-section of this article appear in FIGS. 9 and 10 at magnifications of 250× and 500×, respectively. It can be observed from the SEMs that PTFE masses did not extend from the intersecting PTFE fibers and PTFE islands were not present on the surface of the fibers.

The fiber removal test results were as follows. FIG. 34 shows an SEM of the fabric of this comparative sample at a magnification of 25× after fibers had been easily teased out of the fabric. FIG. 35 shows a SEM of fibers of the fabric of this comparative sample at a magnification of 250× after having been teased from the fabric. The SEMs demonstrate that upon removal of the fiber from the woven article, the fibers had no PTFE masses originating from the fiber intersections. That is, the removed fibers exhibit no presence of hair-like material. Thus, the fabric was determined to lack fray resistance and was easily frayed.

Example 2

Nominal 90d ePTFE round fiber was obtained (part # V112403; W.L. Gore & Associates, Inc., Elkton, Del.), and a woven article was created with this fiber having the following properties: 49.2 ends/cm in the warp direction by 49.2 picks/cm in the weft direction.

The woven article was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 5 passes.

The woven plasma treated article was restrained on a pin frame and placed in a forced air oven (model number CW 7780F, Blue M Electric, Watertown, Wis.) set to 350 deg C. for 15 min. The article was removed from the oven and quenched in water at ambient temperature.

Figure 11:
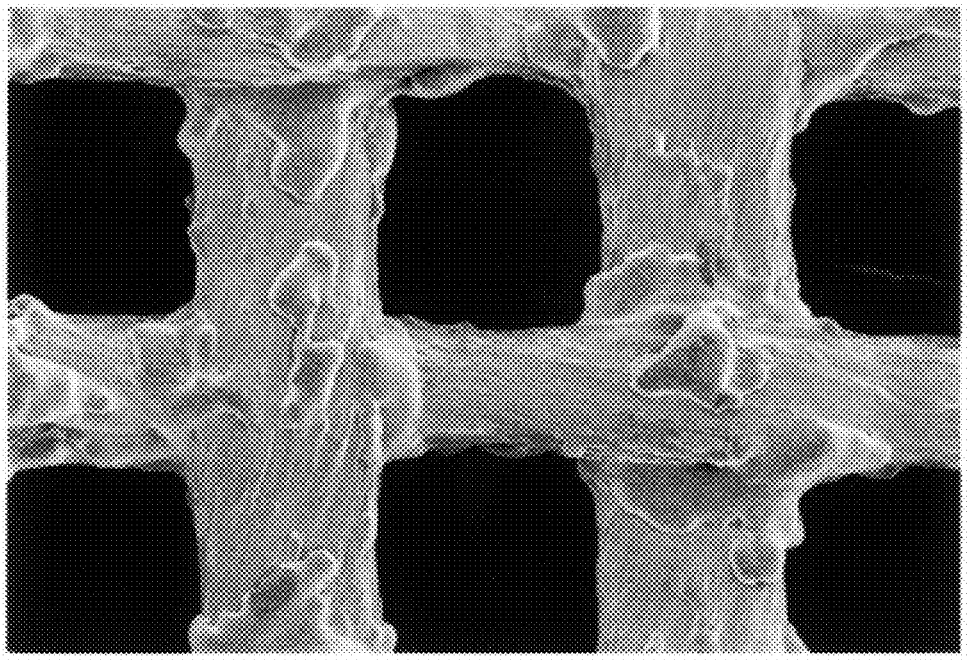
FIG. 11 is an SEM at 250× magnification of the surface of the article made in Example 2.
Figure 12:
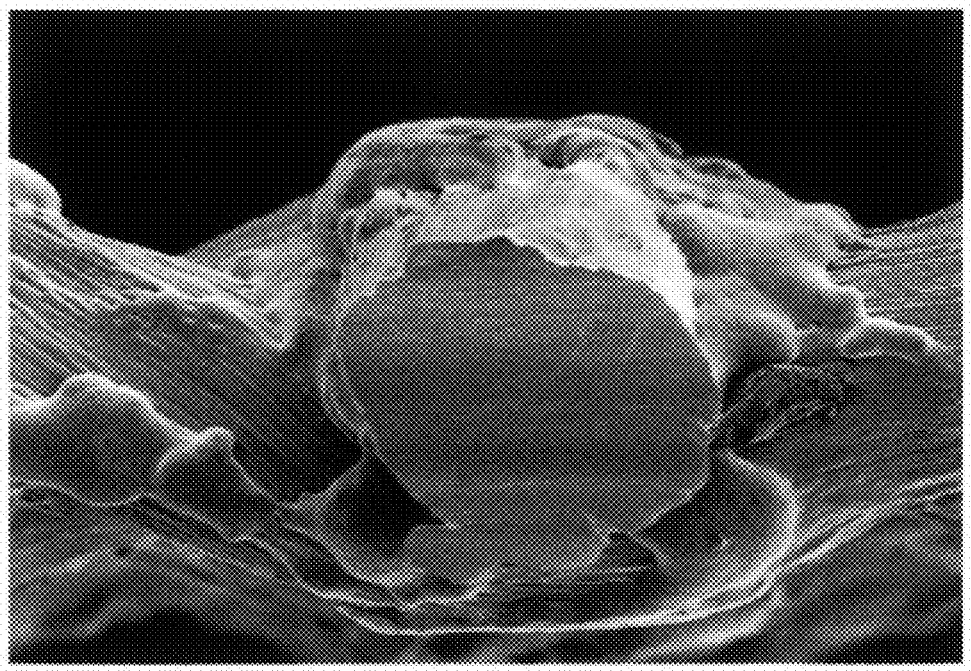
FIG. 12 is an SEM at 500× magnification of the cross-section of the article made in Example 2.

The article was examined with a scanning electron microscope and tested for fray resistance using the fiber removal test described above. Scanning electron micrographs of the surface and cross-section of this article appear in FIGS. 11 and 12, respectively, at magnifications of 250× and 500×, respectively. PTFE masses were observed to extend from at least one of the intersecting PTFE fibers. PTFE islands were also observed on the surface of the fibers.

The fray resistance of the material was tested via the fiber removal test. Upon visual inspection of SEMs of the resulting fibers (not shown) it was observed that portions of the PTFE masses which had been present at the intersections remained attached to the fibers. That is, the removed fibers exhibit the presence of hair-like material due to the disruption of the masses at the intersections. Thus, fray resistance was demonstrated.

Example 3

A nominal 160d, 3.8 g/d, 0.1 mm diameter ePTFE round fiber was obtained and a hexagonal knit ePTFE mesh was formed with this fiber. The knit fabric had the following properties: an areal density of 68 g/m$^2$, 17 courses/cm and 11 wales/cm.

The knitted mesh was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 5 passes.

The knitted plasma treated article was restrained on a pin frame and placed in a forced air oven (model number CW 7780F, Blue M Electric, Watertown, Wis.) set to 350 deg C. for 30 min. The article was removed from the oven and quenched in water at ambient temperature.

Figure 13:
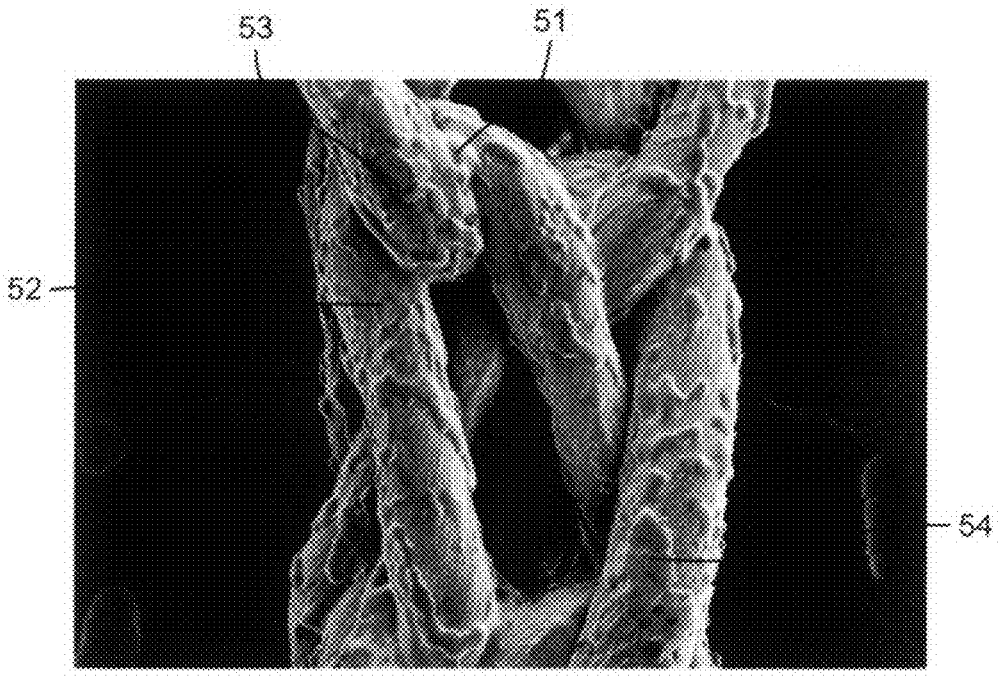
FIG. 13 is an SEM at 100× magnification of the surface of the article made in Example 3.
Figure 14:
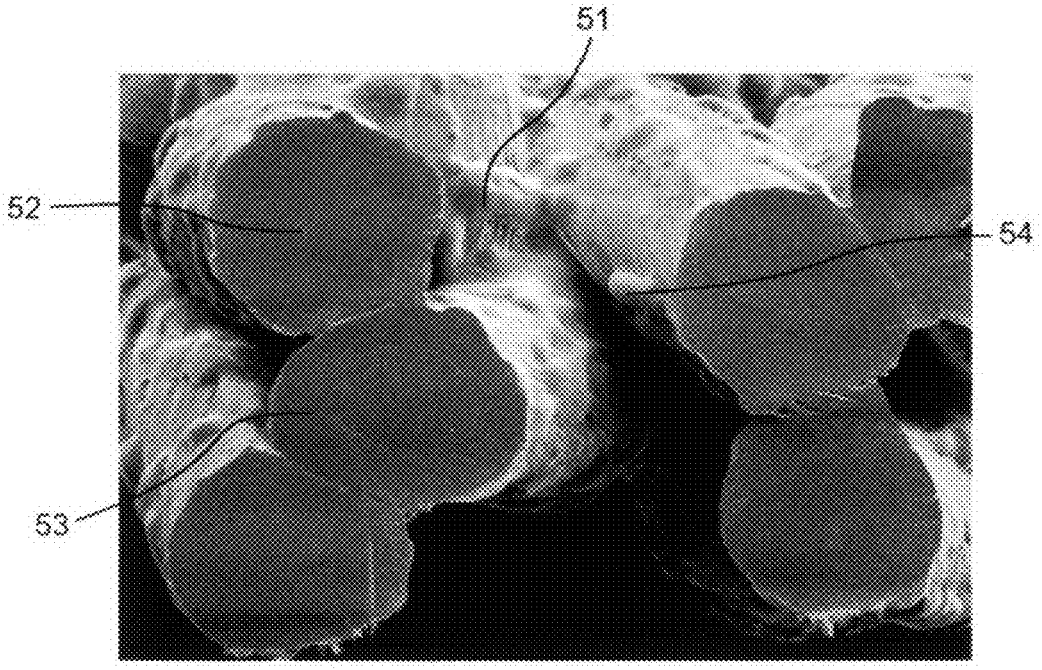
FIG. 14 is an SEM at 250× magnification of the cross-section of the article made in Example 3.

The article was examined with a scanning electron microscope, and scanning electron micrographs of the surface and cross-section of this article appear in FIGS. 13 and 14, respectively, at magnifications of 100× and 250×, respectively. PTFE masses 51 extended from at least one of the intersecting PTFE fibers 52 and 53. PTFE islands 54 were present on the surface of the fibers.

The article was tested for fray resistance in accordance with the fiber removal test method described above. Results were obtained as follows. Specifically, FIG. 36 shows an SEM of the fabric of this example at a magnification of 25× after fibers had been teased from the fabric. FIG. 37 shows an SEM of a fiber of the fabric of this example at a magnification of 250× after performing the Fray Resistance via Fiber Removal Test on the fabric. The hair-like material extending from the fiber had previously comprised a portion of the mass at an intersection of fibers. The SEMs demonstrate that upon removal of the fibers from the knitted article, portions of the PTFE masses from the fiber intersections remained attached to the fibers. Thus, fray resistance was demonstrated.

Comparative Example B

A nominal 160d, 3.8 g/d, 0.1 mm diameter ePTFE round fiber was obtained and a hexagonal knit ePTFE mesh was formed with this fiber. The knit fabric had the following properties: an areal density of 68 g/m$^2$, 17 courses/cm and 11 wales/cm.

The knitted article was restrained on a pin frame and placed in a forced air oven (model number CW 7780F, Blue M Electric, Watertown, Wis.) set to 350 deg C. for 30 min. The article was removed from the oven and quenched in water at ambient temperature.

Figure 15:
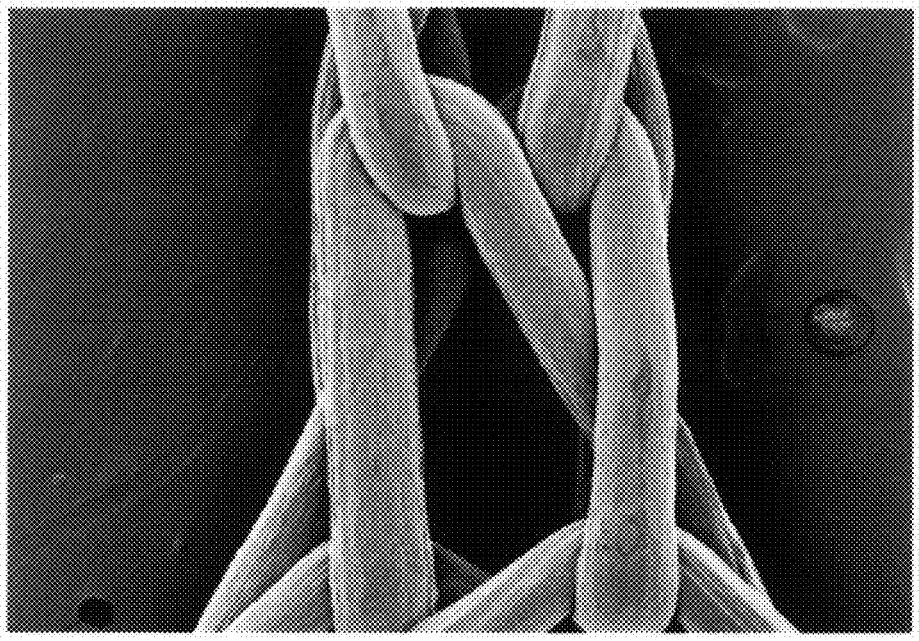
FIG. 15 is an SEM at 100× magnification of the surface of the article made in Comparative Example B.
Figure 16:
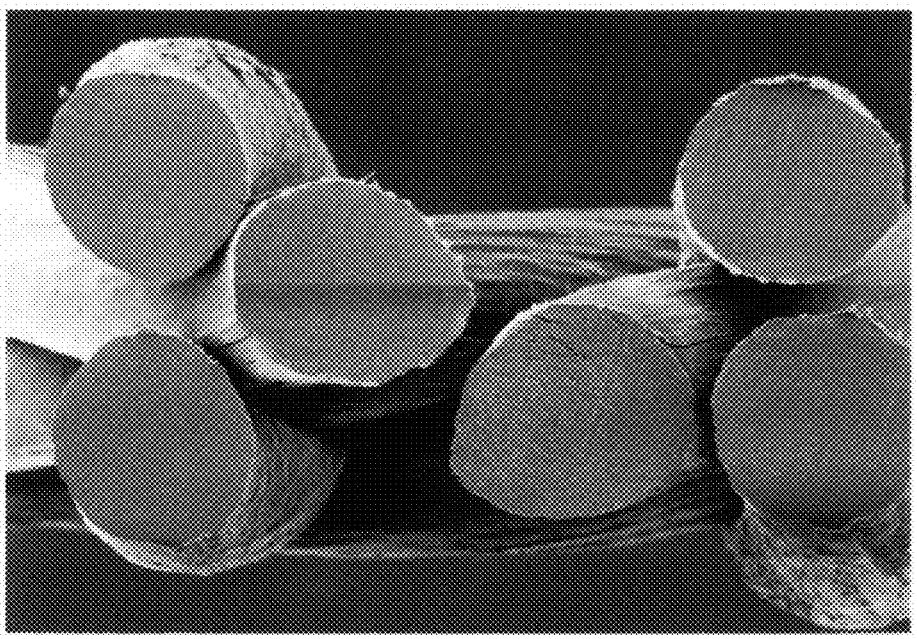
FIG. 16 is an SEM at 250× magnification of the cross-section of the article made in Comparative Example B.

Scanning electron micrographs of the surface and cross-section of this article appear in FIGS. 15 and 16, respectively, at magnifications of 100× and 250×, respectively. PTFE masses did not extend from the intersecting PTFE fibers. Also, PTFE islands were not present on the surface of the fibers.

Example 4

Nominal 400d twisted ePTFE flat fiber was obtained (part # V11828; W.L. Gore & Associates, Inc., Elkton, Del.) and twisted at between 3.9 and 4.7 twists per cm. A woven article was created with this fiber having the following properties: 13.8 ends/cm in the warp direction by 11.8 picks/cm in the weft direction.

The woven article was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 5 passes.

The woven plasma treated article was restrained on a pin frame and placed in a forced air oven (model number CW 7780F, Blue M Electric, Watertown, Wis.) set to 350 deg C. for 45 min. The article was removed from the oven and quenched in water at ambient temperature.

Figure 17:
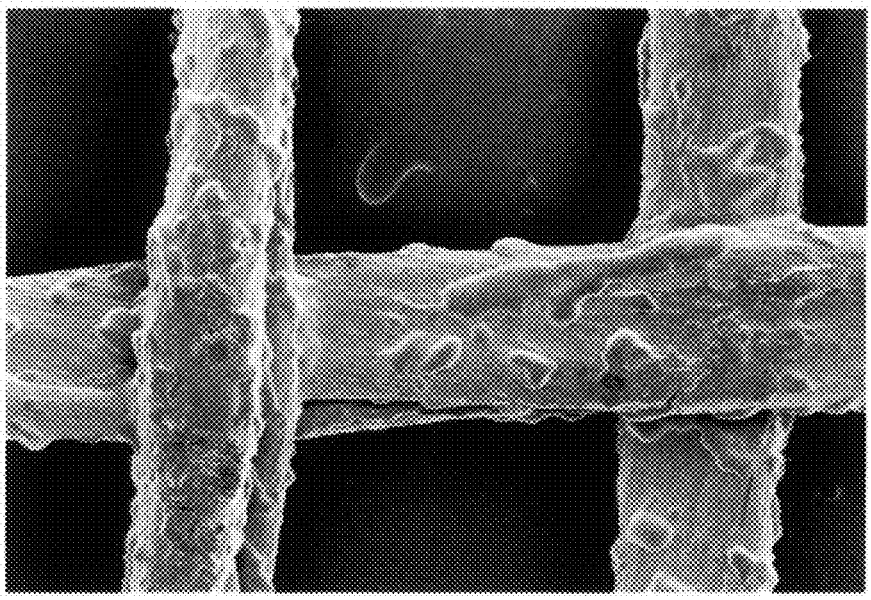
FIG. 17 is an SEM at 100× magnification of the surface of the article made in Example 4.
Figure 18:
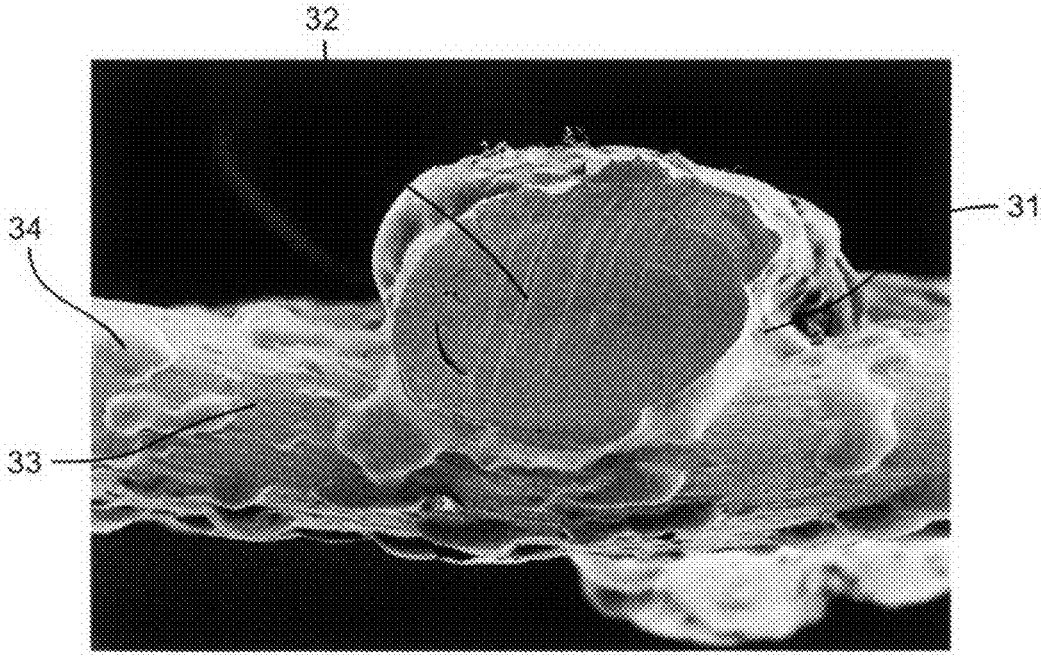
FIG. 18 is an SEM at 250× magnification of the cross-section of the article made in Example 4.

The article was examined with a scanning electron microscope. Scanning electron micrographs of the surface and cross-section of this article appear in FIGS. 17 and 18, respectively, at magnifications of 100× and 250×, respectively. PTFE masses 31 extended from at least one of the intersecting PTFE fibers 32, 33. PTFE islands 34 were present on the surface of the fibers.

Comparative Example C

Nominal 400d twisted ePTFE flat fiber was obtained (part # V11828; W.L. Gore & Associates, Inc., Elkton, Del.) and twisted at between 3.9 and 4.7 twists per cm. A woven article was created with this fiber having the following properties: 13.8 ends/cm in the warp direction by 11.8 picks/cm in the weft direction.

The woven article was restrained on a pin frame and placed in a forced air oven (model number CW 7780F, Blue M Electric, Watertown, Wis.) set to 350 deg C. for 45 min. The article was removed from the oven and quenched in water at ambient temperature.

Figure 19:
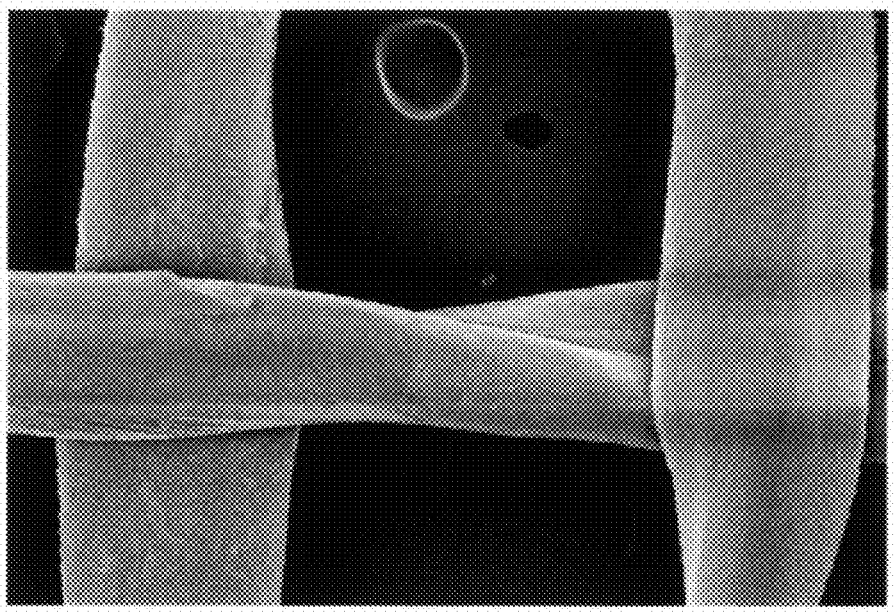
FIG. 19 is an SEM at 100× magnification of the surface of the article made in Comparative Example C.
Figure 20:
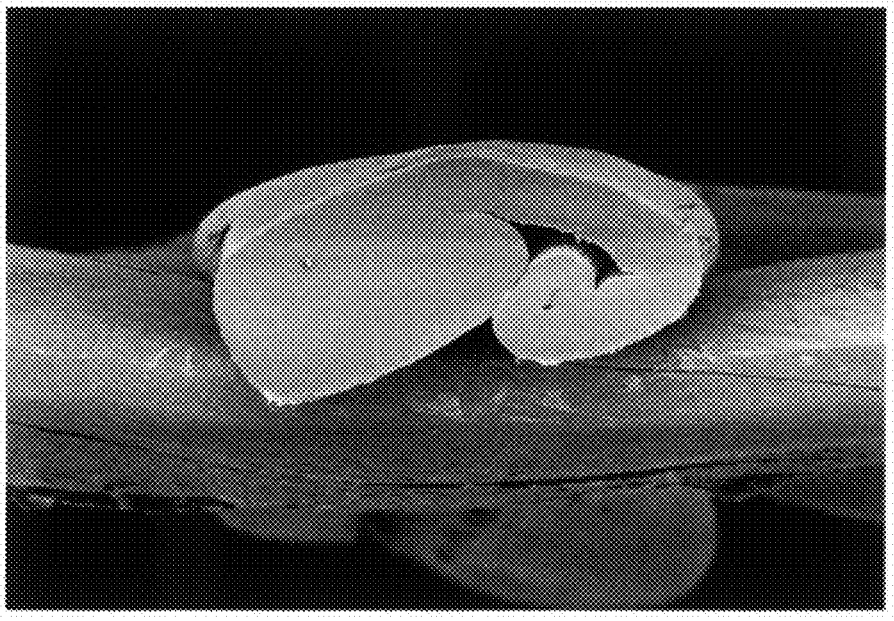
FIG. 20 is an SEM at 250× magnification of the cross-section of the article made in Comparative Example C.

The article was examined with a scanning electron microscope. Scanning electron micrographs of the surface and cross-section of this article appear in FIGS. 19 and 20, respectively, at magnifications of 100× and 250×, respectively. It was observed that PTFE masses did not exist at the intersections of the PTFE fibers. Also, no PTFE islands were present on the surface of the fibers.

Example 5

A tightly woven fabric was obtained having the following properties: 453d spun matrix PTFE fiber (Toray Fluorofibers [America], Inc., Decatur, Ala.), fiber, 31.3 ends/cm in the warp direction by 26.7 ends/cm in the weft direction.

The fabric was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 10 passes.

The woven plasma treated article was restrained on a pin frame and placed in a forced air oven (model number CW 7780F, Blue M Electric, Watertown, Wis.) set to 350 deg C. for 15 min. The article was removed from the oven and quenched in water at ambient temperature.

Figure 21:
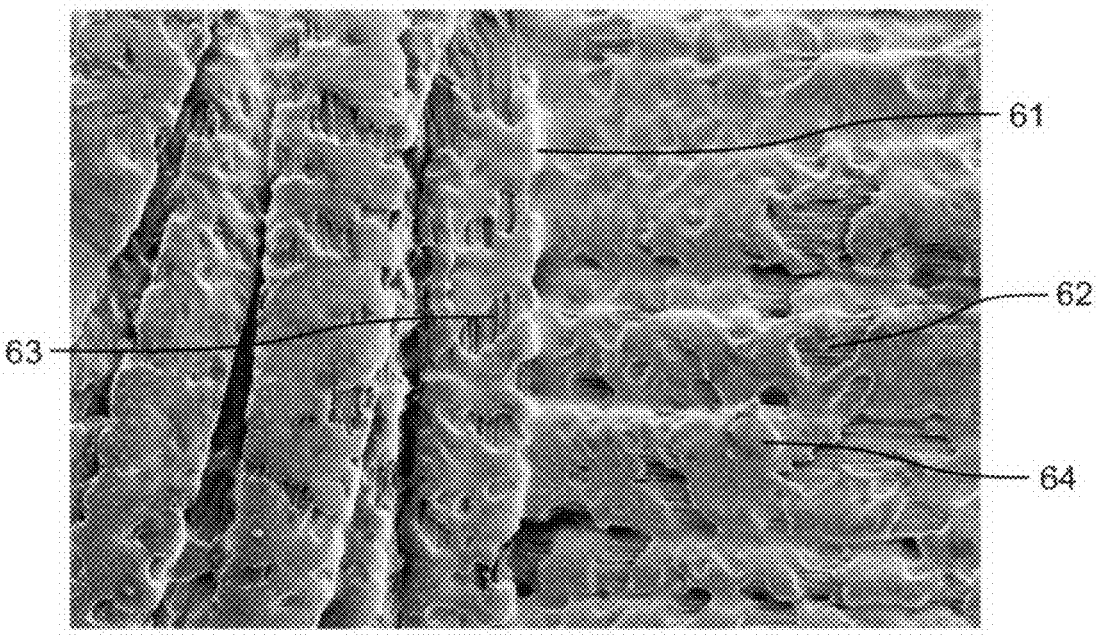
FIG. 21 is an SEM at 500× magnification of the surface of the article made in Example 5.
Figure 22:
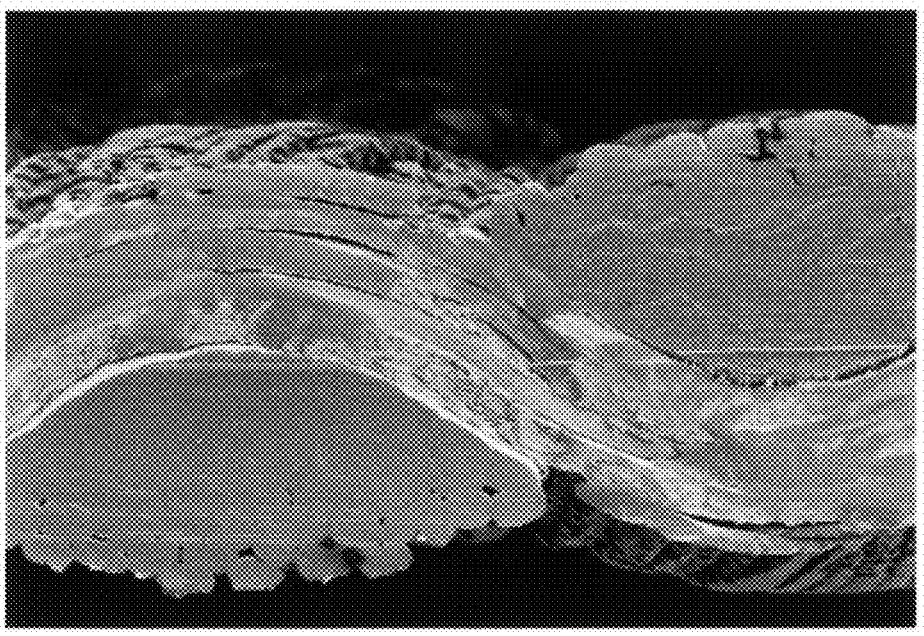
FIG. 22 is an SEM at 250× magnification of the cross-section of the article made in Example 5.

The article was examined with a scanning electron microscope. Scanning electron micrographs of the surface and cross-section of this article appear in FIGS. 21 and 22, respectively, at magnifications of 500× and 250×, respectively. PTFE masses 61 were observed extended from at least one of the intersecting PTFE fibers 62, 63. PTFE islands 64 were present on the surface of the fibers.

Comparative Example D

A tightly woven fabric was obtained having the following properties: 453d spun matrix PTFE fiber (Toray Fluorofibers [America], Inc., Decatur, Ala.), 31.3 ends/cm in the warp direction by 26.7 ends/cm in the weft direction.

The woven fabric was restrained on a pin frame and placed in a forced air oven (model number CW 7780F, Blue M Electric, Watertown, Wis.) set to 350 deg C. for 15 min. The article was removed from the oven and quenched in water at ambient temperature.

Figure 23:
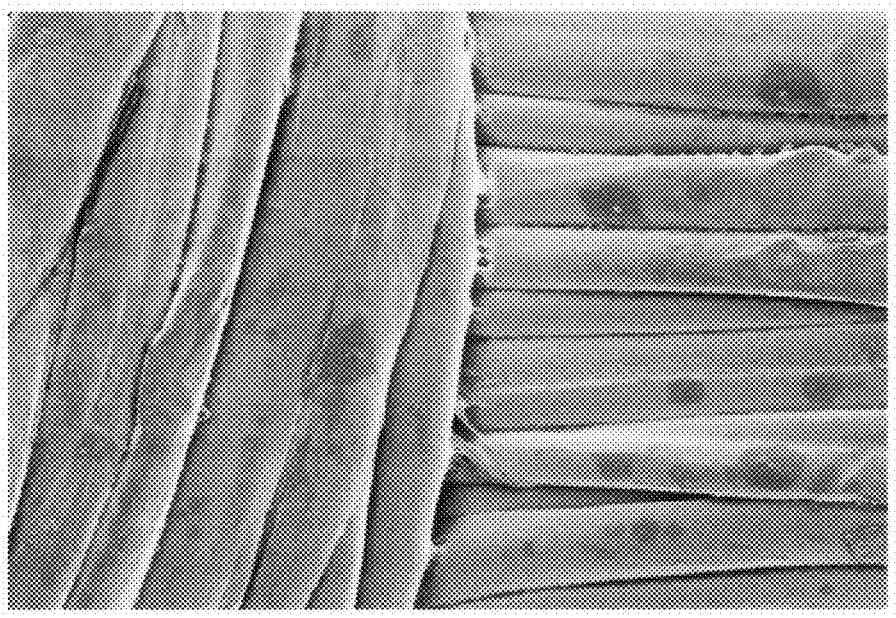
FIG. 23 is an SEM at 500× magnification of the surface of the article made in Comparative Example D.
Figure 24:
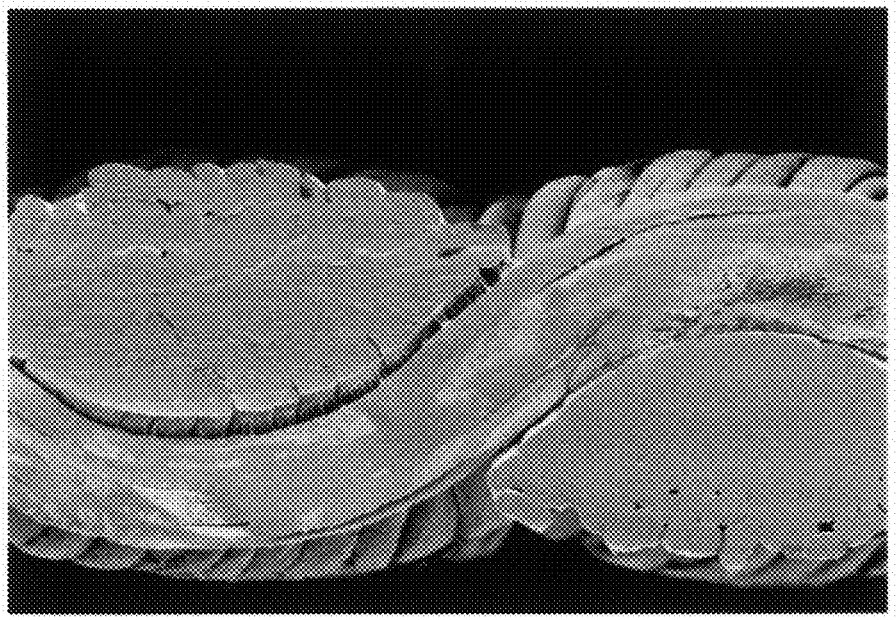
FIG. 24 is an SEM at 250× magnification of the cross-section of the article made in Comparative Example D.

The article was examined with a scanning electron microscope. Scanning electron micrographs of the surface and cross-section of this article appear in FIGS. 23 and 24, respectively, at magnifications of 500× and 250×, respectively. It was observed that no PTFE masses extended from the intersecting PTFE fibers and no PTFE islands were present on the surface of the fibers.

Example 6

Nominal 400d multifilament ePTFE fiber was obtained (part #5816527; W.L. Gore & Associates, Inc., Elkton, Del.), and a woven article was created with this fiber having the following properties: 11.8 ends/cm in the warp direction by 11.9 picks/cm in the weft direction.

The woven article was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 5 passes.

The woven plasma treated article was restrained on a pin frame and placed in a forced air oven (model number CW 7780F, Blue M Electric, Watertown, Wis.) set to 350 deg C. for 40 min. The article was removed from the oven and quenched in water at ambient temperature.

Figure 25:
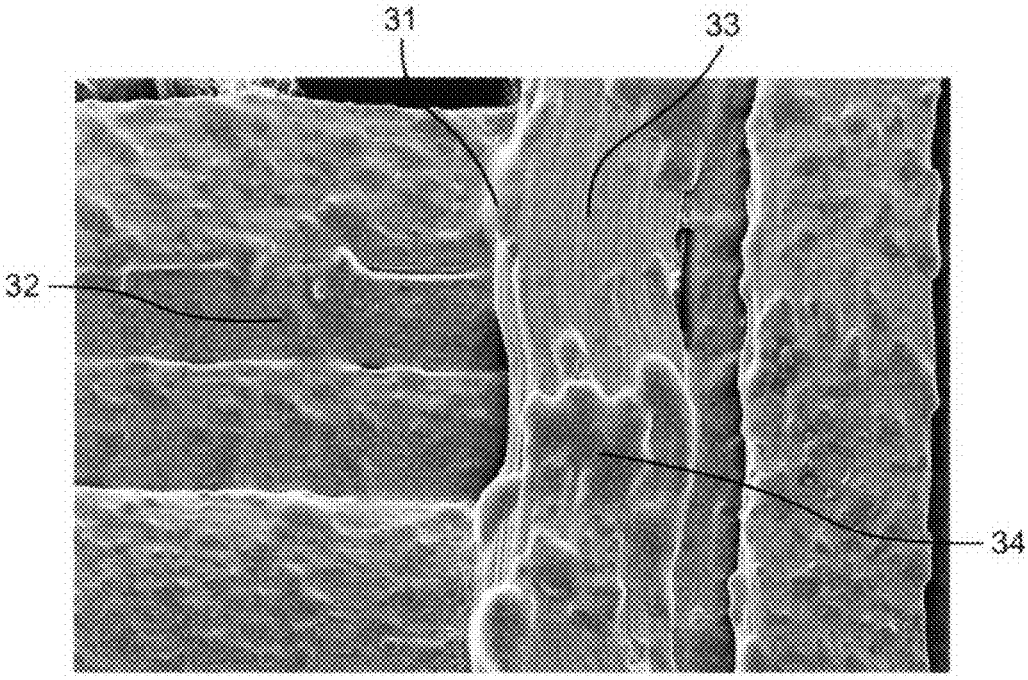
FIG. 25 is an SEM at 500× magnification of the surface of the article made in Example 6.

The article was examined with a scanning electron microscope. A scanning electron micrograph of the surface of this article appears in FIG. 25, at a magnification of 500×. PTFE masses 31 were observed extended from at least one of the intersecting PTFE fibers 32, 33, and PTFE islands 34 were observed on the surface of the fibers.

Comparative Example E

Nominal 400d multifilament ePTFE fiber was obtained (part #5816527; W.L. Gore & Associates, Inc., Elkton, Del.), and a woven article was formed with this fiber having the following properties: 11.8 ends/cm in the warp direction by 11.9 picks/cm in the weft direction.

The woven article was restrained on a pin frame and placed in a forced air oven (model number CW 7780F, Blue M Electric, Watertown, Wis.) set to 350 deg C. for 40 min. The article was removed from the oven and quenched in water at ambient temperature.

Figure 26:
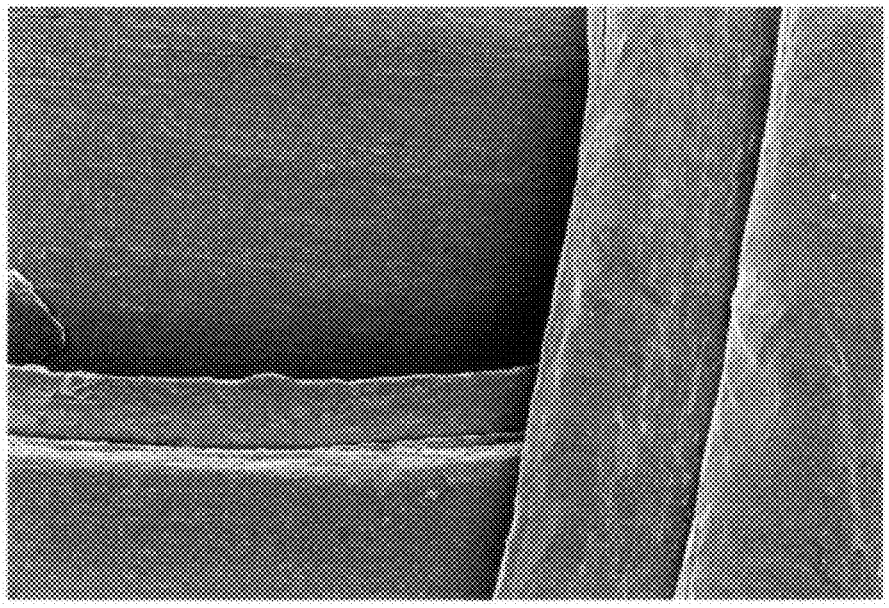
FIG. 26 is an SEM at 500× magnification of the surface of the article made in Comparative Example E.

The article was examined with a scanning electron microscope. A scanning electron micrograph of the surface of this article appears in FIG. 26, at a magnification of 500×. No PTFE masses were observed at the intersecting PTFE fibers, and no PTFE islands were present on the surface of the fibers.

Example 7

Nominal 1204d green pigmented ePTFE fiber was obtained (part #215-3N; Lenzing Plastics, Lenzing, Austria), and a woven article was formed with this fiber having the following properties: 11.8 ends/cm in the warp direction by 11.8 picks/cm in the weft direction.

The woven article was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 5 passes.

The woven plasma treated article was restrained on a pin frame and placed in a forced air oven (model number CW 7780F, Blue M Electric, Watertown, Wis.) set to 350 deg C. for 30 min. The article was removed from the oven and quenched in water at ambient temperature.

The article was examined with a scanning electron microscope. PTFE masses were observed to extend from at least one of the intersecting PTFE fibers and PTFE islands were observed on the surface of the fibers.

Example 8

A hydro-entangled article was made from this ePTFE fiber in the following manner. RASTEX® ePTFE Staple fiber (staple length 65-75 mm, with a fibril density of greater than 1.9 grams/cc, and a fibril denier greater than 15 denier per filament, available from W.L. Gore and Associates, Inc., Elkton, Md.) was obtained and opened using a fan (impeller type) opener. A finish of 1.5% by weight pick-up Katolin PTFE (ALBON-CHEMIE, Dr. Ludwig-E. Gminder KG, Carl-Zeiss-Str. 41, Metzingen, D72555, Germany) and 1.5% by weight pick-up Selbana UN (Cognis Deutschland GmbH, Dusseldorf, Germany) was applied to the staple fiber. Twenty hours after the finish was applied, the staple fiber was carded. A Hergeth Vibra-feed (Allstates Textile Machinery, Inc., Williamston, S.C.) was used to feed the staple fiber to the taker-in rollers on the card. The input speed to the card was 0.03 m/min. The main cylinder rotated to a surface speed of 2500 m/min. The working rollers rotated at surface speeds of 45 and 58 m/min. The fleece exited the card at a speed of 1.5 m/min. The humidity in the carding room was 62% at a temperature of 22-23° C. Subsequent to carding, the fleece was transported at a speed of 1.5 m/min on a transport belt having a pore size of 47 meshes/cm to a hydro-entanglement machine (AquaJet, Fleissner GmbH, Egelsbach, Germany) with a working width of 1 meter.

Two manifolds of the hydro-entanglement machine containing water jets subjected the fleece with streams of water under high pressure thereby creating a wet felt. A water pressure of 20 bar was used in both manifolds during the initial pass through the hydro-entangling process. The felt was then subjected again to the hydro-entanglement process using a water pressure on the first manifold at 100 bar and the second manifold at 150 bar. The speed of the felt through the process was 7 m/min. The wet felt was taken up on a winder. The wet felt passed through the hydro-entanglement machine a third time at a speed of 7.0 m/min. Only the first manifold was used to apply water streams to the felt. The pressure was 150 bar. The speed of the felt during the third pass was 7 m/min. The felt was taken up on a plastic core using a winder and transported via a cart to a forced air oven set at 185° C. The oven opening was set at 4.0 mm. The wet felt was dried at speed of 1.45 m/min resulting in a dwell time of about 1.4 minutes. The dried felt was taken up on a cardboard core.

The hydro-entangled article was plasma treated with an Atmospheric Plasma Treater (model number ML0061-01, Enercon Industries Corp., Menomonee Falls, Wis.) using argon gas. The process parameters were: argon flow rate of 50 L/min, power source of 2.5 kW, line speed of 3 m/min, 7.6 cm electrode length, 20 passes.

The article was restrained on a pin frame and placed in a forced air oven (model number CW 7780F, Blue M Electric, Watertown, Wis.) set to 360 deg C. for 20 min. The article was removed from the oven and quenched in water at ambient temperature.

Figure 27:
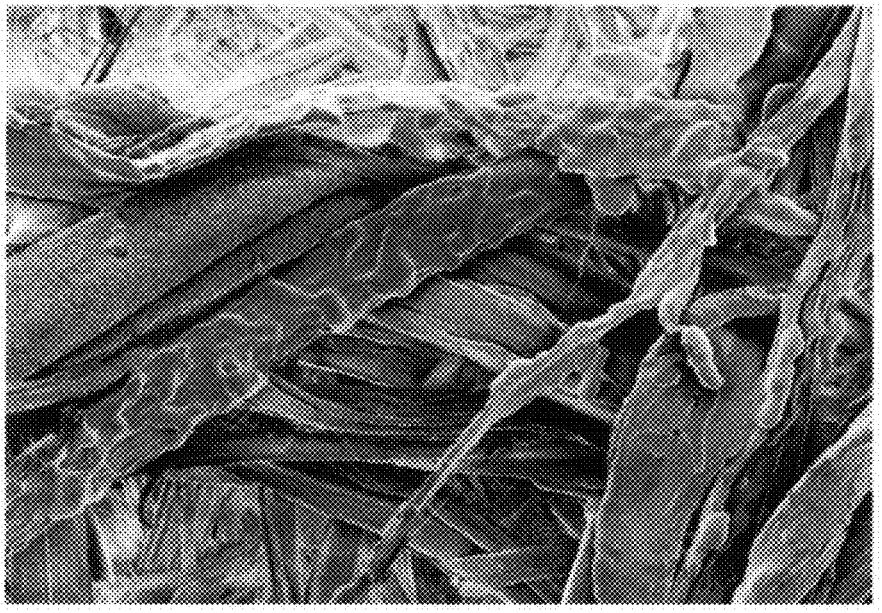
FIG. 27 is an SEM at 250× magnification of the surface of the article made in Example 8.

A scanning electron micrograph of the surface of this article at a magnification of 250× appears in FIG. 27, showing PTFE masses at fiber intersections, the masses extended from at least one of the intersecting PTFE fibers and PTFE islands on the non-intersecting surfaces of the fibers.

Example 9

A shaped article of the present invention was constructed in the following manner.

A woven plasma-treated, but not subsequently heat treated, material formed as described in Example 2 was obtained. The material was wrapped completely around a 25.4 mm diameter steel ball bearing. The excess material was gathered at the base of the bearing, twisted, and secured in place with a wire tie. The wrapped bearing was placed in a forced air oven (model number CW 7780F, Blue M Electric, Watertown, Wis.) set to 350 deg C. for 30 minutes.

The wrapped bearing was removed from the oven and quenched in water at ambient temperature. The tied end was cut and the material was removed from the bearing. The material retained the spherical shape of the bearing when placed on a flat surface. FIG. 38 is a photograph showing the article.

Example 10

The ePTFE fabric of Example 1a was obtained and filled with an ionomer in the following manner. DuPont™ Nafion® 1100 ionomer (DuPont, Wilmington, Del.) was obtained and diluted to create a 24% by weight solids solution in 48% ethanol and 28% water. A 5 cm×5 cm piece of the ePTFE fabric was cut and its edges were taped to an ETFE release film (0.1 mm, DuPont Tefzel® film). Approximately 5 g of the ionomer solution was poured onto the ePTFE fabric, which served as a stabilized woven support. The materials were placed in an oven at 60 deg C. for 1 hour to dry the solvents from the ionomer solution. A second coating of approximately 5 g was applied to the support and the materials were dried again in the same manner. Following drying, the resultant filled membrane was placed in a heated platen Carver press with both platens set to 175 deg C. and pressed at 4536 kg for 5 minutes to eliminate air bubbles and other inconsistencies in the film.

FIG. 39 is an SEM of the cross-section of the article of this Example at 250× magnification showing the encapsulation of the fabric with the ionomer.

Example 11

A hot-pressed laminate of DuPont™ Nafion® 1100 ionomer (DuPont, Wilmington, Del.) and ePTFE was created in the following manner. An ionomer solution was prepared as described in Example 10. Approximately 5 g of the ionomer solution was poured onto an ETFE release film. The release film plus ionomer were placed in an oven at 60 deg C. for 1 hour to dry the solvents from the ionomer solution. In this way, a free standing ionomer film was created. A second ionomer film was made in the same manner.

The ePTFE fabric of Example 1a was obtained and cut to 5 cm×5 cm to serve as a stabilized ePTFE woven support. The stabilized ePTFE woven support was sandwiched between the two fabricated ionomer films. The sandwich structure was then placed between two pieces of ETFE release film and placed in a heated platen Carver press with both platens set to 175 deg C. The materials were pressed at 4536 kg for 5 minutes to incorporate the ionomer into the ePTFE woven fabric. FIG. 40 is an SEM at 250× of the material formed in this Example showing the encapsulation of the fabric with the ionomer.

Example 12a

This example describes the creation of an inventive reinforced membrane. A 90d ePTFE woven fabric was obtained (part # V112403, W.L. Gore & Associates, Inc., Elkton, Md.). The woven fabric construction was 49.2 ends/cm by 49.2 picks/cm.

The fabric was plasma treated with an Atmospheric Plasma Treater (model number ML0061-01, Enercon Industries Corp., Menonomee Falls, Wis.) using argon gas. The process parameters were: argon flow rate of 50 L/min, power source of 2.5 kW, line speed of 3 m/min, 7.6 cm electrode length, 5 passes.

The fabric was next subject to a heating step. The fabric was restrained on a pin frame and placed in a forced air oven (model number CW 7780F, Blue M Electric, Watertown, Wis.) set to 350 deg C. for 5 min. The fabric was removed from the oven and quenched in water at ambient temperature. The fabric was then die cut into 15.2 cm by 15.2 cm pieces.

A commercial 0.2 micron ePTFE membrane (11320na, W.L. Gore & Associates, Inc., Elkton, Md.) was obtained and cut into about 17 cm by 17 cm pieces.

The membrane was placed onto a 30.5 cm by 26.7 cm, 3.1 mm thick aluminum plate such that the higher tensile strength direction of the membrane was aligned with the length of the plate. The woven sample was placed on top of the membrane such that the stronger direction of the membrane was aligned with the warp direction of the fabric. A 3 cm wide, 17 cm long strip of polyimide film (25SGADB grade, UPILEX polyimide film, UBE, Tokyo, Japan) was placed in between the woven and fabric materials in the weft direction such that half of the width of the tape extended beyond the free edge of the materials. A second aluminum plate having the same dimensions and the same orientation as the first plate was placed on top of the woven fabric.

The plates and materials within were placed between the platens of a heated Carver press (Auto "M" Model 3895, Carver Inc., Wabash, Ind.) in order to hot compress the materials. The set points of temperature and the compression force were 360 deg C. and 2268 kg, respectively. Pressure was maintained for 10 min.

The plates with the bonded materials between them were cooled with water and the bonded laminate was removed, thereby providing a reinforced membrane.

The peel strength of the reinforced membrane was measured to be 0.58 kg/cm.

FIG. 42 shows a scanning electron micrograph ("SEM") of the surface of this article, at a magnification of 50×, after being subjected to the peel test Example 12b Another inventive reinforced membrane was constructed in the same manner as described in Example 12a except that the heat step immediately following the plasma treating step was omitted, i.e., the heating was carried out during the hot compression step.

The peel strength of the reinforced membrane was measured to be 0.69 kg/cm.

FIG. 43 shows a scanning electron micrograph ("SEM") of the surface of this article, at a magnification of 50×, after being subjected to the peel test.

Comparative Example F

A reinforced membrane made in accordance with teachings in the art was constructed in the same manner as described in Example 12a except that the plasma treating step and the heat step immediately following the plasma treating step were omitted. Only the hot compression step as described in Example 12a was carried out.

The peel strength of the reinforced membrane was measured to be 0.13 kg/cm.

FIG. 44 shows a scanning electron micrograph ("SEM") of the surface of this article, at a magnification of 50×, after being subjected to the peel test.

Example 13a

Another inventive reinforced membrane was constructed in the same manner as described in Example 12a except that the woven material had 31.5 ends/cm and 23.6 picks/cm.

The peel strength of the reinforced membrane was measured to be 0.71 kg/cm.

FIG. 45 shows a scanning electron micrograph ("SEM") of the surface of this article, at a magnification of 50×, after being subjected to the peel test. As shown in FIG. 45, PTFE mass 105 is shown at the interface of the fabric and the membrane and extends from at least one of the intersecting PTFE fibers 108 and 109. Another PTFE mass 106 is shown, and residual portion 107 of the mass 106 is present on the surface of the membrane as a consequence of the peel test.

Example 13b

Another inventive reinforced membrane was constructed in the same manner as described in Example 12b except that the woven material had 31.5 ends/cm and 23.6 picks/cm.

The peel strength of the reinforced membrane was measured to be 0.44 kg/cm.

FIG. 46 shows a scanning electron micrograph ("SEM") of the surface of this article, at a magnification of 50×, after being subjected to the peel test.

Comparative Example G

A reinforced membrane made in accordance with teachings in the art was constructed in the same manner as described in Example 12a with the following exceptions: the plasma treating step and the heating step were omitted and the woven material had 31.5 ends/cm and 23.6 picks/cm. Only the hot compression step as described in Example 12a was performed.

The peel strength of the reinforced membrane was measured to be 0.13 kg/cm.

FIG. 47 shows a scanning electron micrograph ("SEM") of the surface of this article, at a magnification of 50×, after being subjected to the peel test.

Example 14

Another inventive reinforced membrane was constructed using a knit material.

A 150 d, 3.8 g/d, 0.1 mm diameter ePTFE round fiber in a hexagonal knit ePTFE mesh was obtained (part #1GGNF03, W.L. Gore & Associates, Inc., Elkton, Md.). The knit fabric had the following properties: an areal density of 68 g/m$^2$, 17 courses/cm and 11 wales/cm.

Using this knit material, a reinforced membrane was created in the same manner, with the same membrane, as described in Example 12b with the exception that the masking tape was applied to the membrane (i.e., not the woven fabric) in order to minimize necking.

The peel strength of the reinforced membrane was measured to be 0.27 kg/cm.

FIG. 48 shows a scanning electron micrograph ("SEM") of the surface of this article, at a magnification of 25×, after being subjected to the peel test. The high degree of bonding was observed in that the knit was disrupted to the extent that part of the knit fiber is present on the underlying membrane.

Comparative Example H

A reinforced membrane made in accordance with teachings in the art was constructed in the same manner as described in Example 14 except that the plasma treating step was omitted and the masking tape was applied to the knit fabric.

The peel strength of the reinforced membrane was measured to be 0.05 kg/cm.

FIG. 49 shows a scanning electron micrograph ("SEM") of the surface of this article, at a magnification of 25×, after being subjected to the peel test. It was observed that the degree of bonding was significantly less than that present in the inventive Example 14 as is evident in that the knit was less disrupted during the peel test. Consequently, only a portion of the knit is present on the underlying membrane.

Example 15

Another inventive reinforced membrane was constructed in the same manner as described in Example 12b except that the twisted fiber of the woven fabric (part # V112729, W.L. Gore & Assoc., Inc., Elkton, Md.) had a higher porosity (i.e., a density of 0.7 g/cc) and the woven material had 9.8 ends/cm and 12.6 picks/cm.

The peel strength of the reinforced membrane was measured to be 0.28 kg/cm.

FIG. 50 shows a scanning electron micrograph ("SEM") of the surface of this article, at a magnification of 25×, after being subjected to the peel test.

Comparative Example I

A reinforced membrane made in accordance with teachings in the art was constructed in the same manner as described in Example 15 except that plasma treating step was omitted.

The peel strength of the reinforced membrane was measured to be 0.11 kg/cm.

FIG. 51 shows a scanning electron micrograph ("SEM") of the surface of this article, at a magnification of 25×, after being subjected to the peel test.

Example 16

Another inventive reinforced membrane was constructed in the same manner as described in Example 13b except that a commercial 1 micron ePTFE membrane (part #10066697, W.L. Gore & Associates, Inc., Elkton, Md.) membrane was used.

The peel strength of the reinforced membrane could not be measured because the strength was so high that the membrane broke. That is, the strength of the bond exceeded the tensile strength of the membrane.

FIG. 52 shows a scanning electron micrograph ("SEM") of the surface of this article, at a magnification of 50×, after being subjected to the peel test.

Comparative Example J

A reinforced membrane made in accordance with teachings in the art was constructed in the same manner as Example 16 except that the plasma treating step was omitted.

The peel strength of the reinforced membrane was measured to be 0.06 kg/cm.

FIG. 53 shows a scanning electron micrograph ("SEM") of the surface of this article, at a magnification of 50×, after being subjected to the peel test.

Example 17

Another inventive reinforced membrane was constructed in the same manner as described in Example 12b except that the twisted fiber of the woven fabric (part # W112190, W.L. Gore &Assoc., Inc., Elkton, Md.) was a PFA/PTFE blend and the woven material had 17.7 ends/cm and 19.7 picks/cm.

The peel strength of the reinforced membrane was measured to be 0.38 kg/cm.

FIG. 54 shows a scanning electron micrograph ("SEM") of the surface of this article, at a magnification of 25×, after being subjected to the peel test.

Comparative Example K

A reinforced membrane was constructed in the same manner as Example 17 except that the plasma treating step was omitted.

The peel strength of the reinforced membrane was measured to be 0.19 kg/cm.

FIG. 55 shows a scanning electron micrograph ("SEM") of the surface of this article, at a magnification of 25×, after being subjected to the peel test.

FIG. 56 is a table that summarizes the process steps of each example.

The invention claimed is:

1. An article comprising:

a fabric comprising a plurality of PTFE fibers overlapping at intersections, wherein at least a portion of the intersections have PTFE masses extending from at least one of the overlapping PTFE fibers and which lock the overlapping PTFE fibers together, said fabric bonded to a membrane by at least said PTFE masses.

2. The article of claim 1, wherein said plurality of PTFE fibers overlapping at intersections comprises a structure selected from the group consisting of knitted fibers, woven fibers, a laid scrim of fibers, perforated PTFE sheet and non-woven fibers.

3. The article of claim 1, wherein said PTFE fibers comprise expanded PTFE.

4. The article of claim 1, wherein said PTFE fibers comprise a plurality of PTFE monofilaments combined in a twisted configuration.

5. The article of claim 1, wherein said PTFE fibers comprise one or more forms selected from the group consisting of monofilaments, multifilaments and staple fibers.

6. The article of claim 1, wherein said PTFE fibers comprise one or more geometries selected from the group consisting of round, flat and twisted.

7. The article of claim 1, wherein said PTFE fibers comprise at least one additional material.

8. The article of claim 1, wherein said article further comprises PTFE islands on at least some PTFE fibers.

9. The article of claim 1, further comprising at least one additional material incorporated in said article.

10. The article of claim 1, further comprising at least one additional material coated on at least a portion of said PTFE fibers.

11. The article of claim 1, further comprising at least one additional material impregnated into the article.

12. The article of claim 11, wherein said at least one additional material comprises at least one ionomer.

13. The article of claim 1, wherein said article comprises a layer of a multi-layered structure.

14. The article of claim 1, wherein said article comprises a component of an electrochemical cell.

15. The article of claim 1, wherein said article comprises a component of an acoustic device.

16. The article of claim 1, wherein said article comprises a component of a filter.

17. The article of claim 1, wherein said article comprises a component of a medical device.

18. The article of claim 1 having a geometry selected from the group consisting of a membrane, a tube, a sheet and a three dimensional shape.

19. The article of claim 17, incorporated as a component of an implantable medical device.

20. The article of claim 1, wherein said membrane comprises an expanded PTFE membrane.

21. The article of claim 20, wherein said expanded PTFE membrane comprises at least one filler.

22. The article of claim 1, wherein the fabric is fray resistant.

23. An article comprising:

a fabric comprising a plurality of PTFE fibers overlapping at intersections, wherein at least a portion of the intersections have PTFE masses extending from at least one of the overlapping PTFE fibers and which lock the overlapping PTFE fibers together, said fabric bonded to a membrane by said PTFE masses.

24. The article of claim 1, wherein upon subjecting said article to a peel test, residual portions of fabric are present on the membrane surface.

25. A method for forming a PTFE article comprising:

providing a PTFE fabric comprising a plurality of PTFE fibers overlapping at intersections, wherein at least a portion of the intersections have PTFE masses extending from at least one of the overlapping PTFE fibers and which lock the overlapping PTFE fibers together;

bonding said PTFE fabric to a membrane.

26. A method for forming a PTFE article comprising:

providing a PTFE fabric comprising a plurality of PTFE fibers overlapping at intersections;

plasma treating said PTFE fabric;

placing said PTFE fabric in contact with a PTFE membrane; and heat bonding said PTFE fabric to said PTFE membrane to form PTFE masses which lock the overlapping PTFE fibers together at said intersections and which extend from at least one of the overlapping PTFE fibers to bond said PTFE fabric to said PTFE membrane.

27. The method for forming a PTFE article of claim 26, wherein said masses migrate to said intersections upon heating.

28. A method for forming a PTFE article comprising:

plasma treating PTFE fibers;

forming a PTFE fabric from said plasma treated PTFE fibers, the PTFE fabric comprising a plurality of PTFE fibers overlapping at intersections;

placing said PTFE fabric in contact with a PTFE membrane; and heat bonding said PTFE fabric to said PTFE membrane to form PTFE masses which lock the overlapping PTFE fibers together at said intersections and which extend from at least one of the overlapping PTFE fibers to bond said PTFE fabric to said PTFE membrane.

* * * * *